US008695892B2

(12) United States Patent
Kobane et al.

(10) Patent No.: US 8,695,892 B2
(45) Date of Patent: Apr. 15, 2014

(54) FUEL INJECTION DEVICE

(75) Inventors: Yoichi Kobane, Kuwana (JP); Shuichi Matsumoto, Kariya (JP); Naofumi Adachi, Takahama (JP); Tsukasa Yamashita, Kariya (JP); Fumihiro Fujikake, Tajimi (JP)

(73) Assignee: Denso Corporation, Kariya (JP)

( * ) Notice: Subject to any disclaimer, the term of this patent is extended or adjusted under 35 U.S.C. 154(b) by 387 days.

(21) Appl. No.: 13/022,795

(22) Filed: Feb. 8, 2011

(65) Prior Publication Data

US 2011/0198418 A1 Aug. 18, 2011

(30) Foreign Application Priority Data

Feb. 18, 2010 (JP) ..... 2010-33965

(51) Int. Cl.
*F02M 41/16* (2006.01)

(52) U.S. Cl.
USPC ..... 239/96; 239/88; 239/124; 239/533.2; 239/585.1; 123/445; 123/467; 251/129.15

(58) Field of Classification Search
USPC ..... 239/88, 96, 124, 533.2, 585.1; 123/457, 123/467, 445, 514, 518; 251/129.15
See application file for complete search history.

(56) References Cited

U.S. PATENT DOCUMENTS 4,826,080 A 5/1989 Ganser
5,244,150 A * 9/1993 Ricco et al. ..... 239/96
5,246,165 A * 9/1993 De Matthaeis et al. ..... 239/96
5,732,679 A 3/1998 Takahasi et al.
5,897,098 A 4/1999 Nishinosono et al.
6,092,737 A * 7/2000 Bosch et al. ..... 239/96
6,892,955 B2 * 5/2005 Grabandt ..... 239/88

FOREIGN PATENT DOCUMENTS

EP 1 656 498 5/2006
JP 10-110853 4/1998

OTHER PUBLICATIONS

Japanese Office Action dated May 8, 2012, issued in corresponding Japanese Application No. 2010-033965 with English translation.
Office Action (6 pages) dated Nov. 13, 2012, issued in corresponding Chinese Application No. 201110041145.2 and English translation (4 pages).

* cited by examiner

*Primary Examiner* — Dinh Q Nguyen
(74) *Attorney, Agent, or Firm* — Nixon & Vanderhye P.C.

(57) ABSTRACT

In a fuel injection device, a control body has a pressure control chamber, an inflow port and an outflow port. The inflow port and the outflow port are opened at an abutting surface exposed to the pressure control chamber. In the pressure control chamber is arranged a floating plate for pressing the abutting surface by a pressing surface with the pressure of the fuel to interrupt communication between the inflow port and the pressure control chamber. The abutting surface of the control body is provided with an outer opposite surface portion opposite to an outer edge of the pressing surface in a displacement axis direction of the floating plate, and the outer opposite surface portion has a special depressed portion that is depressed in the displacement axis direction and that extends along the shape of the outer edge of the pressing surface.

14 Claims, 10 Drawing Sheets

FUEL INJECTION DEVICE

CROSS REFERENCE TO RELATED APPLICATION

This application is based on Japanese Patent Application No. 2010-33965 filed on Feb. 18, 2010, the contents of which are incorporated herein by reference in its entirety.

FIELD OF THE INVENTION

The present invention relates to a fuel injection device that opens and closes a valve portion to control an injection of supply fuel supplied form a supply channel and injected from a nozzle hole, and that discharges a portion of the supply fuel to a return channel based on the control.

BACKGROUND OF THE INVENTION

There has been known a fuel injection device including a control body, which has a pressure control chamber, and a valve member for opening and closing a valve portion in response to the pressure of fuel in the pressure control chamber.

In the fuel injection device, the pressure control chamber of the control body has an inflow port and an outflow port opened therein. The inflow port is a port through which fuel flowing through a supply channel flows into the pressure control chamber, and the outflow port is a port through which the fuel is discharged to a return channel. The pressure of the fuel in the pressure control chamber is controlled by a pressure control valve for making communication between the outflow port and the return channel and for interrupting the communication between them.

In a fuel injection device disclosed in Patent document 1 (JP-A-6-108948 corresponding to U.S. Pat. No. 4,826,080), a pressing member is further provided in a pressure control chamber, to be reciprocally displaced in the pressure control chamber. The pressing member has a pressing surface formed in an end surface in an axial direction. The pressing surface is opposite in a displacement axis direction of the pressing member to an abutting surface that is exposed to the pressure control chamber and that has an inflow port and an outflow port opened therein.

When the outflow port is made to communicate with the return channel by the pressure control valve, the pressing member is drawn to the abutting surface having the outflow port opened therein by the flow of the fuel flowing to the outflow port from the pressure control chamber, thereby pressing the abutting surface by the pressing surface.

Furthermore, when the abutting surface is pressed by the pressing surface, the pressing member interrupts the communication between the inflow port and the pressure control chamber, and the outflow port.

When the communication between the outflow port and the return channel are interrupted by the pressure control valve, the pressing member receives pressure in a direction to separate the pressing surface from the abutting surface by the flow of the fuel flowing into the pressure control chamber from the inflow port.

Then, not only the fuel in the inflow port but also the fuel in the outflow port and in the pressure control chamber enters between the pressing surface and the abutting surface to eliminate the close contact between the pressing surface and the abutting surface. While the close contact between the pressing surface and the abutting surface is eliminated, the pressing member starts to be displaced by the pressure received from the fuel in the inflow port.

When the inflow port, the pressure control chamber and the outflow port are brought into the state of communication by the displacement of the pressing member, the pressure of the fuel in the pressure control chamber is increased. Thus, the valve member closes the valve portion in response to an increase in the pressure of the fuel in the pressure control chamber. Furthermore, when the valve portion is closed as described above to stop the fuel from being supplied to the nozzle hole, the fuel injection device stops the injection of the fuel from the nozzle hole.

In the fuel injection device disclosed in the Patent document 1, for the valve member to close the valve portion, it is necessary that the pressing member is separated from the abutting surface to bring the inflow port and the pressure control chamber into the state of communication to increase the pressure of fuel in the pressure control chamber.

A clearance as a communication channel needs to be formed between an outer peripheral wall portion of the pressing member and an inner peripheral wall portion that surrounds the abutting surface and that partitions the pressure control chamber. However, when the clearance is formed between the inner peripheral wall portion that partitions the pressure control chamber and the outer peripheral wall portion of the pressing member, the pressing member is displaced along the abutting surface to cause a shift in the position where the pressing surface abuts on the abutting surface.

The shift in the position where the pressing surface abuts on the abutting surface increases or decreases the contact width of the pressing surface and the abutting surface, specifically, increase or decrease a distance from the inflow port or the outflow port to an outer edge of the pressing surface.

The close contact between the pressing surface and the abutting surface is hard to be eliminated in a portion where the contact width of the pressing surface and the abutting surface is large but is easy to be eliminated in a portion where the contact width of them is small. Thus, an increase or a decrease in the contact width of the pressing surface and the abutting surface causes a variation in the time that elapses before the close contact between the pressing surface and the abutting surface is eliminated. Accordingly, the variation in the time causes a variation in the timing at which the pressing member starts to be displaced after the flow of the fuel from the outflow port to the return channel is interrupted by the pressure control valve.

When the timing at which the pressing member starts to be displaced is varied, the pressure in the pressure control chamber cannot be stably increased, thereby causing a variation in the timing at which the valve portion is closed by the valve member. Thus, a variation in the amount of the fuel injected from the nozzle hole is increased, thereby resulting in reducing the injection accuracy of the fuel injection device.

SUMMARY OF THE INVENTION

The present invention has been made in view of the above-described problem, and the object of the present invention is to provide a fuel injection device in which a variation in the timing at which a pressing member starts to be displaced is reduced, thereby improving injection accuracy.

According to an aspect of the present invention, a fuel injection device is adapted to open and close a valve portion for controlling an injection of supply fuel supplied from a supply channel and injected from a nozzle hole, and to discharge a portion of the supply fuel into a return channel based on the control of the injection. The fuel injection device is provided with a control body that includes a pressure control chamber, into which the fuel flowing through the supply channel flows from an inflow port and from which the fuel is discharged to the return channel through an outflow port, and an abutting surface exposed to the pressure control chamber and having the inflow port and the outflow port opened therein. The fuel injection device further includes a pressure control valve configured to make communication between the outflow port and the return channel and to interrupt the communication so as to control pressure of the fuel in the pressure control chamber; a valve member configured to open and close the valve portion in response to the pressure of the fuel in the pressure control chamber; and a pressing member arranged to be reciprocally displaced in the pressure control chamber and having a pressing surface abutting on the abutting surface when being reciprocally displaced. In the fuel injection device, the pressing surface presses the abutting surface to interrupt communication between the inflow port and the pressure control chamber when the communication between the outflow port and the return channel is made by the pressure control valve, the pressing surface is displaced to open the inflow port of the abutting surface to the pressure control chamber when the communication between the outflow port and the return channel is interrupted by the pressure control valve, and the abutting surface has an outer opposite surface portion that is opposite to an outer edge of the pressing surface in a displacement axis direction of the pressing member and is provided with a special depressed portion depressed in the displacement axis direction and extending along a shape of the outer edge of the pressing surface.

As described above, the control body is provided with the special depressed portion depressed from the outer edge opposite surface portion and extending along the shape of the outer edge of the pressing surface, and the outer edge opposite surface portion is a portion of the abutting surface and opposite to the outer edge of the pressing surface in the displacement axis direction. Thus, the special depressed portion extends over the outer edge of the pressing surface in the radial direction in the state where the pressing surface abuts on the abutting surface that has the inflow port and the outflow port formed therein and that is exposed to the pressure control chamber. Here, the inflow port is a port through which the fuel flowing through the supply channel flows in, and the outflow port is a port through which the fuel discharged to the return channel flows out.

Since the special depressed portion strides over the outer edge of the pressing surface in the radial direction in this manner, the contact width of the pressing surface and the abutting surface becomes a distance from the inflow port or the outflow port to the special depressed portion in the abutting surface.

Thus, even if the pressing member is displaced along the abutting surface to shift the position where the pressing surface abuts on the abutting surface, the contact width of the pressing surface and the abutting surface is not increased or decreased within a range in which the special depressed portion strides over the outer edge of the pressing surface. Since the contact width is not increased or decreased, a variation in the time that elapses before the close contact between the pressing surface and the abutting surface is eliminated after the flow of the fuel from the outflow port to the return channel is interrupted by the pressure control valve can be prevented. Therefore, a variation in the timing at which the pressing member starts to be displaced can be reduced. Accordingly, the pressure in the pressure control chamber can be stably increased. Thus, a variation in the timing at which the valve portion is closed by the valve member can be prevented, so that the amount of fuel injected from the nozzle hole is hard to vary. As a result, the fuel injection device can be improved in injection accuracy.

For example, the special depressed portion may be formed in the shape of a ring extending along the shape of the outer edge of the pressing surface. In this case, the special depressed portion shaped like a ring can extends over the outer edge of the pressing surface along the peripheral direction of the special depressed portion. Thus, it is possible to readily obtain the effect of the special depressed portion, that is, the effect of preventing the contact width of the pressing surface and the abutting surface from increasing or decreasing. As a result, it is possible to further ensure the effect of preventing a variation in the time that elapses before the close contact between the pressing surface and the abutting surface is eliminated.

For example, the abutting surface may be surrounded by a cylindrical wall portion that is formed in the shape of a circular cylinder and that partitions the pressure control chamber. In this case, the pressing member shaped like a circular disk may be arranged in the cylindrical wall portion and may have the pressing surface formed at an end surface in the displacement axis direction, and the width of the special depressed portion in the radial direction of the cylindrical wall portion may be larger than a difference between an inner diameter of the cylindrical wall portion and an outer diameter of the pressing member.

Because the pressing member shaped like the circular disk is arranged in the cylindrical wall portion to surround the abutting surface, the pressing member can be displaced in a direction along the abutting surface by the difference between the inner diameter of the cylindrical wall portion and the outer diameter of the pressing member.

When the width of the special depressed portion in the radial direction of the cylindrical wall portion is made larger than the difference between the inner diameter of the cylindrical wall portion and the outer diameter of the pressing member, the special depressed portion can surely stride over the outer edge of the pressing surface in the radial direction in the state where the pressing surface abuts on the abutting surface. Therefore, the special depressed portion reliably allows the outer edge of the pressing surface to be shifted along the abutting surface. Thus, it is possible to reliably prevent the contact width of the abutting surface and the pressing surface from increasing or decreasing.

Furthermore, the control body may have an inflow depressed portion formed on an inner peripheral side of the special depressed portion, the inflow depressed portion may be concentric with the special depressed portion and depressed from the abutting surface separately and independently from the special depressed portion, and the inflow depressed portion may form the inflow port.

Because the inflow depressed portion is independently provided from the special depressed portion and is depressed from the abutting surface on the inner peripheral side of the special depressed portion in a manner concentric with the special depressed portion, the contact width, in which a surface portion that is a portion of the abutting surface and that connects the inflow depressed portion to the special depressed portion is brought into contact with the pressing surface, can be made constant along the peripheral direction of the special depressed portion. In addition, the fuel flowing through the supply channel flows into the inflow depressed portion that defines the inflow port. Accordingly, the contact width in which the surface portion that connects the inflow depressed portion to the special depressed portion is brought into contact with the pressing surface can be made constant along the peripheral direction of the special depressed portion. Thus, the close contact between the surface portion and the pressing surface can be eliminated uniformly along the peripheral direction by the fuel entering between the surface portion and the pressing surface. Therefore, the problem can be prevented that when the pressing member starts to be displaced, the displacement axis direction of the pressing member is inclined with respect to the axial direction of the cylindrical wall portion. Accordingly, when the pressing member starts to be displaced, the behavior of the pressing member can be made stable, and thereby a variation in the timing at which the pressing member starts to be displaced can be further reduced.

On an inner peripheral side and an outer peripheral side of the inflow depressed portion, a continuing surface portion continuously extending to the abutting surface may be formed along the displacement axis direction. When the peripheral wall surface of the inflow depressed portion is formed in this shape, even if the abutting surface is pressed by the pressing surface and is worn along the displacement axis direction, the position in the radial direction of the continuing surface portion of the peripheral wall surface is not shifted. Thus, the position in which the inflow depressed portion is depressed in the abutting surface and the width in the radial direction of the inflow depressed portion are not varied. Furthermore, the force that the pressing member receives from the fuel in the inflow depressed portion when the pressing member starts to be displaced is hard to vary even if the abutting surface is worn. Accordingly, the behavior of the pressing member when the inflow port is opened to the pressure control chamber can be made stable for a long time.

For example, a depth dimension of the special depressed portion may be smaller than a depth dimension of the inflow depressed portion. In this case, the fuel flowing through the supply channel flows into the inflow depressed portion, so that pressure in the inflow depressed portion can be made higher than pressure in the special depressed portion communicating with the pressure control chamber. Thus, a separation portion configured to separate the inflow depressed portion from the special depressed portion needs to have a strength enough to resist to a difference between the pressure in the inflow depressed portion and the pressure in the special depressed portion. Even in this case, it is possible to ensure the thickness of the separation portion that is configured to separate the inflow depressed portion from the special depressed portion, and thereby it is possible to enhance the strength of the separation portion.

The control body may further have an outflow depressed portion formed on an inner peripheral side of the inflow depressed portion and in a central portion in the radial direction of the abutting surface, and the outflow depressed portion forming the outflow port may be depressed from the abutting surface. In this case, the contact width of a surface portion, which is a portion of the abutting surface and connects the inflow depressed portion to the outflow depressed portion, can be made uniform along the peripheral direction of the inflow depressed portion. Thus, the close contact between the surface portion and the pressing surface can be eliminated uniformly along the peripheral direction by the fuel entering between the surface portion and the pressing surface from the inflow depressed portion. Therefore, the problem can be prevented that when the pressing member starts to be displaced, the displacement axis direction of the pressing member is inclined with respect to the axial direction of the cylindrical wall portion.

Furthermore, on the abutting surface, a connecting surface portion connecting the outflow depressed portion to the inflow depressed portion may be inclined inward in the radial direction toward a bottom side of the outflow depressed portion. Accordingly, when the pressing member starts to be displaced, the connecting surface portion that is elastically deformed is restored into a shape inclined inward in the radial direction toward the bottom side of the outflow depressed portion, so that the fuel is easy to enter between the abutting surface and the pressing surface. Thus, the close contact between the connecting surface portion and the pressing surface can be easily eliminated. Therefore, when the pressing member opens the inflow port to the pressure control chamber, the behavior of the pressing member can be made more stable.

Furthermore, a peripheral wall surface of the outflow depressed portion may be inclined inward in the radial direction toward a bottom side of the outflow depressed portion. In this case, the wall portion for separating the outflow depressed portion from the inflow depressed portion can have its width increased on the bottom side of the outflow depressed portion.

The inflow depressed portion may have a stepped surface portion formed on the inner peripheral wall surface thereof, and the stepped surface portion may have a reduced width in the radial direction of the inflow depressed portion on a bottom side of the inflow depressed portion. Therefore, the wall portion configured to separate the outflow depressed portion from the inflow depressed portion has its width increased on the bottom side of the inflow depressed portion. Accordingly, the strength of the wall portion for separating the outflow depressed portion from the inflow depressed portion can be enhanced.

Furthermore, the pressing member may have a reduced diameter portion formed outside in the radial direction of the pressing surface, and the reduced diameter portion may have a reduced outer diameter of the pressing surface with respect to an outermost diameter of the pressing member. Accordingly, in the pressing member in which the reduced diameter portion reducing the outer diameter of the pressing surface with respect to the outermost diameter of the pressing member is formed radially outside of the pressing surface, the pressing surface is formed in a concentrated manner in the central portion of the end surface. When the pressing surface is formed in a concentrated manner in the central portion of the end surface of the pressing member, even if the axial direction of the pressing member is inclined with respect to a correct displacement axis direction, the contact pressure caused between the pressing surface and the abutting surface is easily made uniform over the whole pressing surface.

Thus, it is possible to prevent a fuel leak between the pressing surface and the abutting surface, thereby providing a pressing member that presses the abutting surface by the pressing surface to reliably interrupt communication between the inflow port and the pressure control chamber.

The pressing member may be depressed toward an end surface that defines the pressing surface and that is located in the displacement axis direction, thereby forming the reduced diameter portion. Alternatively, the pressing member may form the reduced diameter portion inclined inward in the radial direction toward the end surface that forms the pressing surface and that is located in the displacement axis direction. Furthermore, the reduced diameter portion inclined in this manner may be curved to have a part of a spherical surface.

BRIEF DESCRIPTION OF THE DRAWINGS

Additional objects and advantages of the present invention will be more readily apparent from the following detailed description of preferred embodiments when taken together with the accompanying drawings. In which.

EMBODIMENTS

Figure 1:
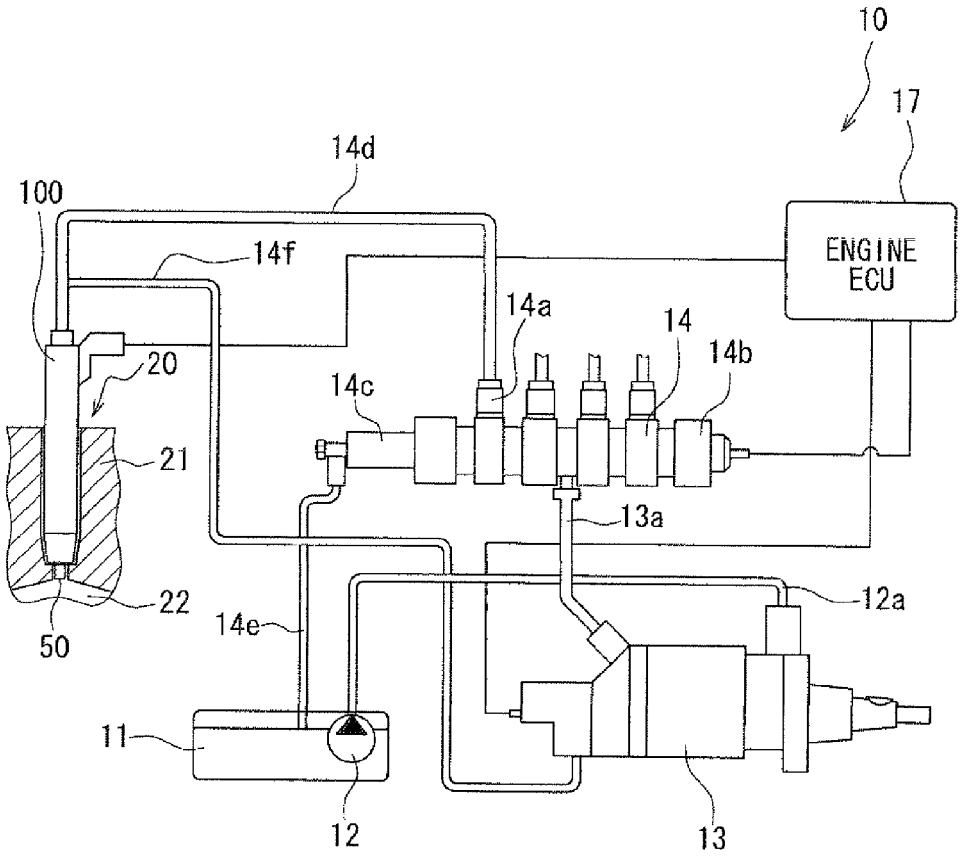
FIG. 1 is a schematic diagram showing a fuel supply system having a fuel injection device according to a first embodiment of the present invention.

Embodiments for carrying out the present invention will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

A fuel supply system 10 in which a fuel injection device 100 according to a first embodiment of the present invention is used is shown in FIG. 1. The fuel injection device 100 of the present embodiment is a so-called direct injection fuel supply system in which fuel is directly injected into a combustion chamber 22 of a diesel engine 20 as an internal combustion engine.

The fuel supply system 10 is configured of a feed pump 12, a high-pressure fuel pump 13, a common rail 14, an engine control device 17, the fuel injection device 100, and the like.

The feed pump 12 is an electrically driven pump and is housed in a fuel tank 11. The feed pump 12 applies a feed pressure to fuel stored in the fuel tank 11, such that the feed pressure is higher than the vapor pressure of the fuel. The feed pump 12 is connected to the high-pressure fuel pump 13 with a fuel pipe 12*a* and supplies the liquid-state fuel, which has the specified feed pressure applied thereto, to the high-pressure fuel pump 13. The fuel pipe 12*a* has a pressure control valve (not shown) fitted thereto and the pressure of the fuel supplied to the high-pressure fuel pump 13 is held at a specified value by the pressure control valve.

The high-pressure fuel pump 13 is attached to the diesel engine 20 and is driven by power from an output shaft of the diesel engine 20. The high-pressure fuel pump 13 is connected to the common rail 14 by a fuel pipe 13*a*, and further applies pressure to the fuel supplied by the feed pump 12 to supply the fuel to the common rail 14.

In addition, the high-pressure fuel pump 13 has an electromagnetic valve (not shown) electrically connected to the engine control device 17. The electromagnetic valve is opened or closed by the engine control device 17, and thereby the pressure of the fuel supplied from the high-pressure fuel pump 13 to the common rail 14 is optimally controlled.

The common rail 14 is a pipe-shaped member made of a metal material such as chromium molybdenum steel and has a plurality of branch parts 14*a*. The number of the plurality of branch parts 14 corresponds to the number of cylinders per bank of the diesel engine. Each of the branch parts 14*a* is connected to the fuel injection device 100 by a fuel pipe forming a supply channel 14*d*.

The fuel injection device 100 and the high-pressure fuel pump 13 are connected to each other by a fuel pipe forming a return channel 14*f*. According to the above-described structure, the common rail 14 temporarily stores the fuel supplied in a high-pressure state by the high-pressure fuel pump 13, and distributes the fuel to the plurality of fuel injection devices 100 with the pressure held in the high-pressure state through the supply channels 14*d*.

In addition, the common rail 14 has a common rail sensor 14*b* provided at one end portion of both end portions in an axial direction, and has a pressure regulator 14*c* provided at the other end portion thereof. The common rail sensor 14*b* is electrically connected to the engine control device 17 and detects the pressure and the temperature of the fuel and outputs them to the engine control device 17. The pressure regulator 14*c* maintains the pressure of the fuel in the common rail 14 at a constant value, and decompresses and discharge excess fuel. The excess fuel passing through the pressure regulator 14*c* is returned to the fuel tank 11 through a channel in a fuel pipe 14*e* that connects the common rail 14 to the fuel tank 11.

The fuel injection device 100 is a device for injecting high-pressure supply fuel supplied through the branch part 14*a* of the common rail 14, from a nozzle hole 44. Specifically, the fuel injection device 100 has a valve portion 50 that controls the injection of the supply fuel injected from the nozzle hole 44 according to a control signal from the engine control device 17. The supply fuel is supplied from the high-pressure pump 13 through the supply channel 14*d*.

In addition, in the fuel injection device 100, the excess fuel, which is a portion of the supply fuel supplied from the supply channel 14*d* and is not injected from the nozzle hole 44, is discharged into the return channel 14*f* through which the fuel injection device 100 communicates with the high-pressure fuel pump 13, and then is returned to the high-pressure fuel pump 13.

The fuel injection device 100 is inserted into and fitted into an insertion hole made in a head member 21 that is a portion of the combustion chamber 22 of the diesel engine 20. In the present embodiment, a plurality of the fuel injection devices 100 are arranged for each combustion chamber 22 of the diesel engine 20 and each of them injects the fuel directly into the combustion chamber 22, specifically, with an injection pressure of a range from 160 to 220 megapascal (MPa).

The engine control device 17 is configured of a microcomputer or the like. The engine control device 17 is electrically connected to not only the common rail sensor 14*b* described above but also various kinds of sensors such as a rotational speed sensor for detecting the rotational speed of the diesel engine 20, a throttle sensor for detecting a throttle opening, an air flow sensor for detecting an intake air volume, a boost pressure sensor for detecting a boost pressure, a water temperature sensor for detecting a cooling water temperature, and an oil temperature sensor for detecting the oil temperature of lubricating oil.

The engine control device 17 outputs an electric signal for controlling the opening/closing of the electromagnetic valve of the high-pressure fuel pump 13 and the valve portion 50 of each fuel injection device 100, to the electromagnetic valve of the high-pressure fuel pump 13 and to each fuel injection device 100 on the basis of information from these respective sensors.

Figure 2:
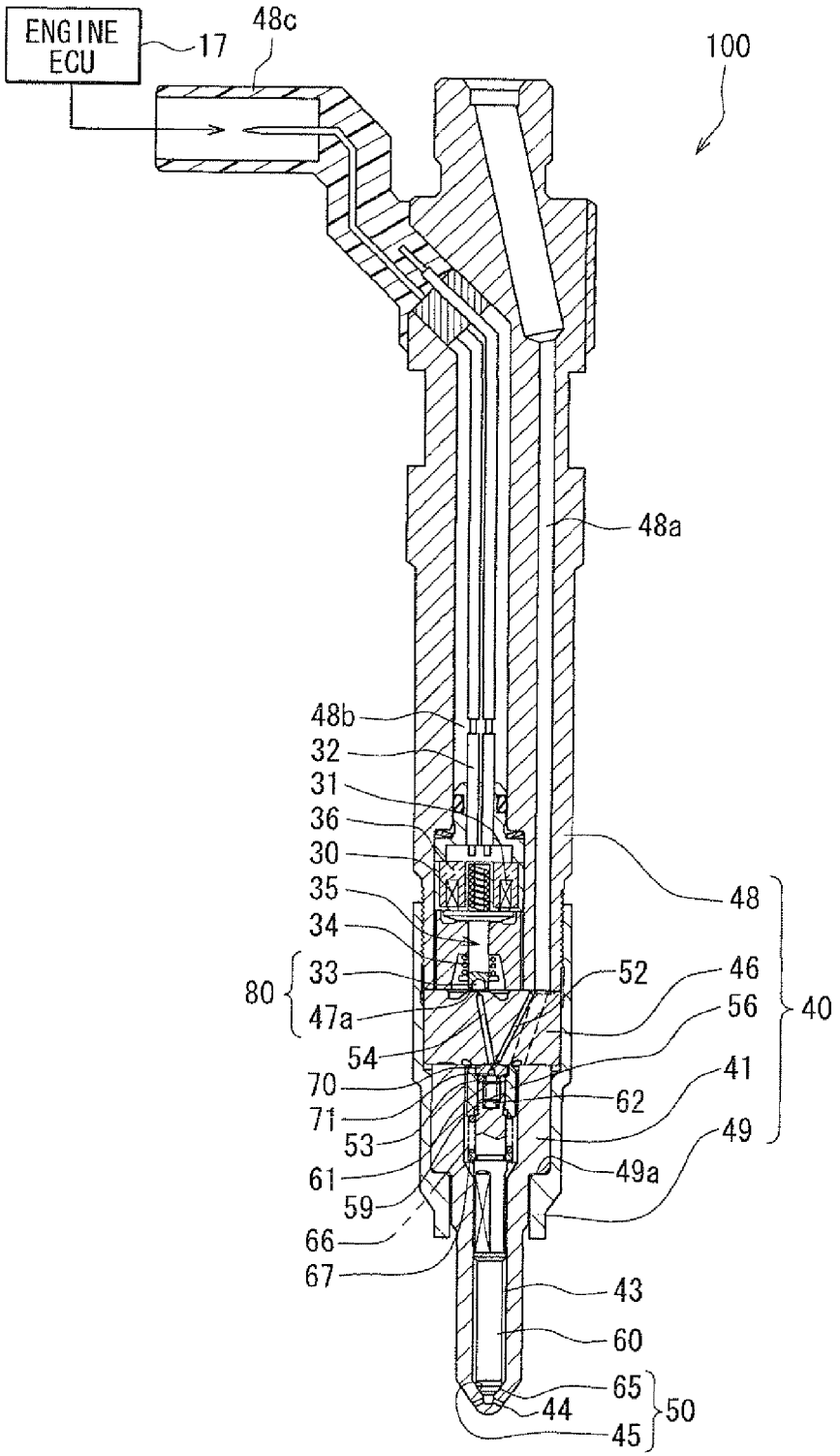
FIG. 2 is a longitudinal section view of the fuel injection device according to the first embodiment of the present invention.
Figure 3:
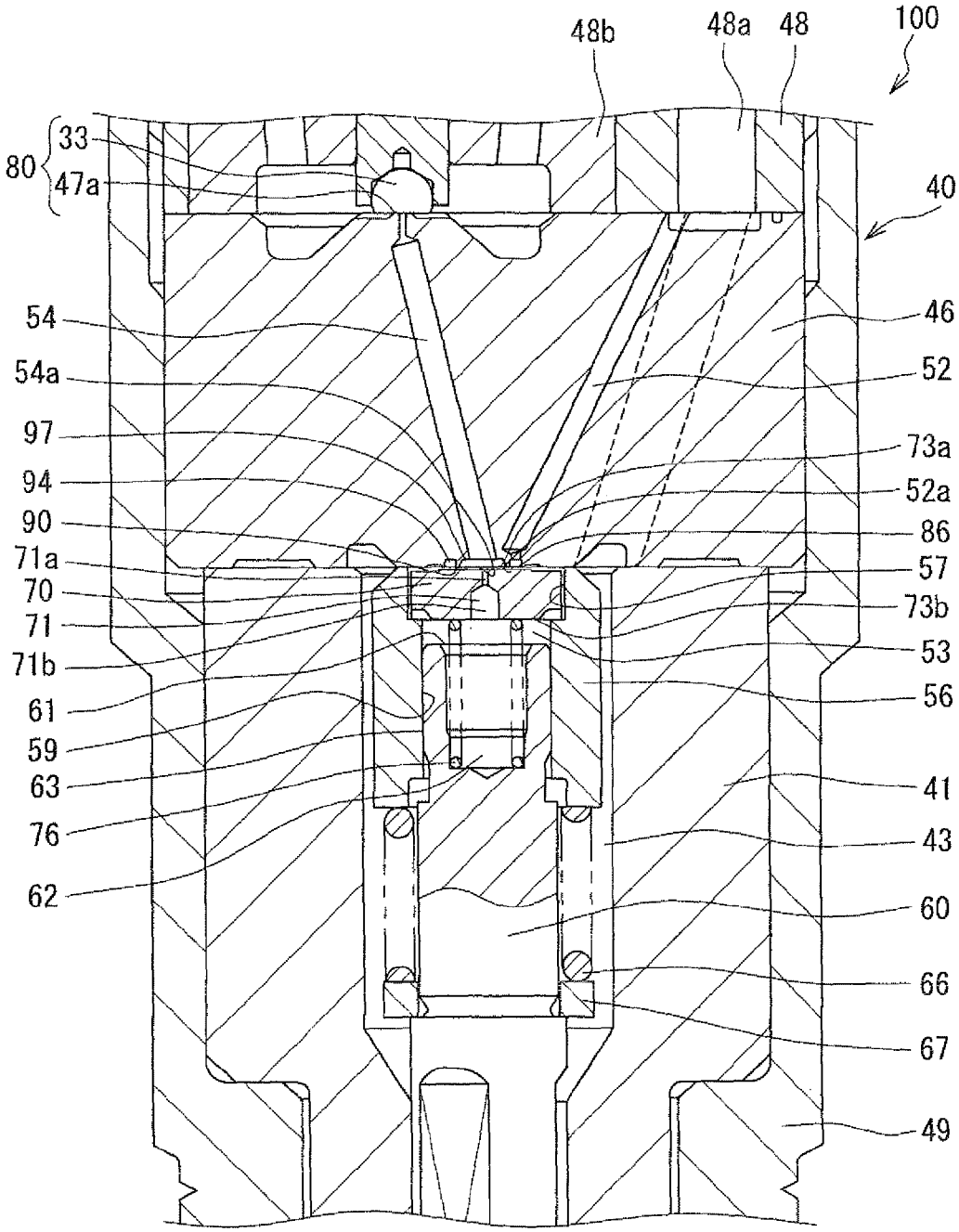
FIG. 3 is a partially enlarged view showing a portion of the fuel injection device according to the first embodiment of the present invention.

Next, the structure of the fuel injection device 100 will be further described with reference to FIG. 1, FIG. 2 and FIG. 3.

The fuel injection device 100 includes a control valve driving part 30, a control body 40, a nozzle needle 60, a plate spring 76, and a floating plate 70.

The control valve driving part 30 is housed in the control body 40. The control valve driving part 30 includes a terminal 32, a solenoid 31, a fixed member 36, a movable member 35, a spring 34, and a valve seat member 33. The terminal 32 is formed of a metal material having electrical conductivity and has one end portion of both end portions in an extending direction exposed to the outside from the control body 40 and has the other end portion thereof connected to the solenoid 31. The solenoid 31 is spirally wound and is supplied with a pulse current from the engine control device 17 via the terminal 32.

When the solenoid 31 is supplied with this current, the solenoid 31 generates a magnetic field circling along the axial direction. The fixed member 36 is a cylindrical member formed of a magnetic material and is magnetized in the magnetic field generated by the solenoid 31. The movable member 35 is a member formed of a magnetic material and in the shape of a cylinder having two steps and is arranged on a tip side in the axial direction of the fixed member 36. The movable member 35 is attracted to a base end side in the axial direction by the magnetized fixed member 36.

The spring 34 is a coil spring made by winding a metal wire in the shape of a circle and biases the movable member 35 in a direction to separate the movable member 35 from the fixed member 36. The valve seat member 33 forms a pressure control valve 80 together with a control valve seat portion 47*a* of the control body 40. The control valve seat portion 47*a* will be described later. The valve seat member 33 is arranged on the opposite side of the fixed member 36 in the axial direction of the movable member 35, and is seated on the control valve seat portion 47*a*.

When the magnetic field is not generated by the solenoid 31, the valve seat member 33 is seated on the control valve seat portion 47*a* by the biasing force of the spring 34. In contrast, when the magnetic field is generated by the solenoid 31, the valve seat member 33 is separated from the control valve seat portion 47*a*.

The control body 40 has a nozzle body 41, a cylinder 56, a valve body 46, a holder 48, and a retaining nut 49. The nozzle body 41, the valve body 46, and the holder 48 are arranged in this order from a tip side in a direction in which they are inserted into the head member 21 having the nozzle hole 44 formed therein (see FIG. 1).

The control body 40 has an inflow channel 52, an outflow channel 54, a pressure control chamber 53, and an abutting surface 90 exposed to the pressure control chamber 53. The inflow channel 52 communicates with a side of the supply channel 14*d* (see FIG. 1) connected to the high-pressure fuel pump 13 and the common rail 14, and has an inflow port 52*a* opened at the abutting surface 90. The inflow port 52*a* is a channel end of the inflow channel 52.

The outflow channel 54 communicates with a side of the return channel 14*f* (see FIG. 1) connected to the high-pressure fuel pump 13, and has an outflow port 54*a* opened at the abutting surface 90. The outflow port 54*a* is a channel end of the outflow channel 54.

The pressure control chamber 53 is partitioned by the cylinder 56 and the like, and the fuel passing through the supply channel 14*d* (see FIG. 1) flows into the pressure control chamber 53 from the inflow port 52*a* and flows out of the pressure control chamber 53 to the return channel 14*f* (see FIG. 1) from the outflow port 54*a*.

The nozzle body 41 is a member made of a metal material such as chromium molybdenum steel or the like in the shape of a circular cylinder and closed at one end. The nozzle body 41 has a nozzle needle housing portion 43, a valve seat portion 45, and the nozzle hole 44.

The nozzle needle housing portion 43 is formed along the axial direction of the nozzle body 41, and is a cylindrical hole in which a nozzle needle 60 is housed. The nozzle needle housing portion 43 has high-pressure fuel that is supplied from the high-pressure fuel pump 13 and the common rail 14 (see FIG. 1).

The valve seat portion 45 is formed on the bottom wall of the nozzle needle housing portion 43 and is brought into contact with the tip end of the nozzle needle 60. The nozzle hole 44 is located on the opposite side of the valve body 46 with respect to the valve seat portion 45. A plurality of the nozzle holes 44 are formed radially from the inside of the nozzle body 41 to the outside thereof.

When the high-pressure fuel passes through the nozzle holes 44, the high-pressure fuel is atomized and diffused, thereby being brought into a state where the fuel is easily mixed with air.

The cylinder 56 is a member made of a metal material in the shape of a circular cylinder, and is arranged coaxially with the nozzle needle housing portion 43 within the nozzle needle housing portion 43. In the cylinder 56, an end surface located on a side of the valve body 46 in the axial direction is held by the valve body 46.

An inner peripheral wall of the cylinder 56 forms a cylindrical wall portion 57 that is formed in the shape of a circular cylinder and that defines the pressure control chamber 53 together with the valve body 46 and the nozzle needle 60. The cylindrical wall portion 57 surrounds the abutting surface 90 in the shape of a ring. Further, of the inner peripheral wall of the cylinder 56, a portion closer to the nozzle hole 44 than the cylindrical wall portion 57 in the axial direction forms a cylinder sliding portion 59 that is formed in the shape of a circular cylinder and that slides the nozzle needle 60 along its axial direction.

The valve body 46 is a member made of a metal material such as chromium molybdenum steel in the shape of a circular column, and is held between the nozzle body 41 and the holder 48. The valve body 46 has a control valve seat portion 47*a*, the abutting surface 90, the outflow channel 54, and the inflow channel 52.

The control valve seat portion 47*a* is formed on one end surface of the both end surfaces on a side of the holder 48 in the axial direction of the valve body 46, and constructs the pressure control valve 80 together with the valve seat member 33 of the control valve driving part 30 and the like.

The abutting surface 90 is formed in a central portion in the radial direction of an end surface of the valve body 46 on a side of the nozzle body 41. The abutting surface 90 is surrounded by the cylindrical cylinder 56 and is formed in a circular shape. The outflow channel 54 extends toward the control valve seat portion 47*a* from a central portion in the radial direction of the abutting surface 90. Furthermore, the outflow channel 54 is inclined with respect to the axial direction of the valve body 46.

The inflow channel 52 is extended toward an end surface forming the control valve seat portion 47*a* from the outside in the radial direction of the outflow channel 54 in the abutting surface 90. The inflow channel 52 is inclined with respect to the axial direction of the valve body 46.

The valve body 46 has an outflow depressed portion 97 that is depressed from the abutting surface 90 and that forms the outflow port 54*a*. The valve body 46 has an inflow depressed portion 94 that is depressed from the abutting surface 90 and that forms the inflow port 52*a*. The outflow depressed portion 97 is depressed in the shape of a circle in the central portion, in the radial direction of the abutting surface 90.

The inflow depressed portion 94 is located outside in the radial direction of the outflow depressed portion 97 in the abutting surface 90, and is depressed concentrically with the outflow depressed portion 97 and in the shape of a circular ring. The outflow depressed portion 97 and the inflow depressed portion 94 are provided independent of each other, and are not connected to each other.

The holder 48 is a member made of a metal material such as chromium molybdenum steel in the shape of a cylinder, and has longitudinal holes 48*a*, 48*b* formed along the axial direction and has a socket portion 48*c*.

The longitudinal hole 48*a* is a fuel channel that makes the supply channel 14*d* (see FIG. 1) communicate with the inflow channel 52. On the other hand, the longitudinal hole 48*b* has therein the control valve driving part 30 on a side of the valve body 46. In addition, in the longitudinal hole 48*b*, the socket portion 48*c* is formed at a portion on the opposite side of the valve body 46, in such a way as to close the opening of the longitudinal hole 48*b*.

The socket portion 48*c* has one end of the terminal 32 of the control valve driving part 30 projected thereinto and has a plug portion (not shown) detachably fitted therein. The plug portion is connected to the engine control device 17. When the socket portion 48*c* is connected to the plug portion (not shown), a pulse current can be supplied to the control valve driving part 30 from the engine control device 17.

The retaining nut 49 is a member made of a metal material in the shape of a circular cylinder having two steps. The retaining nut 49 houses a portion of the nozzle body 41 and the valve body 46, and is screwed with a portion of the holder 48 on a side of the valve body 46. In addition, the retaining nut 49 has a stepped portion 49*a* on the inner peripheral wall portion thereof. When the retaining nut 49 is fitted to the holder 48, the stepped portion 49*a* presses the nozzle body 41 and the valve body 46 toward the holder 48. In this manner, the retaining nut 49 holds and pinches the nozzle body 41 and the valve body 46, together with the holder 48.

The nozzle needle 60 is formed of a metal material such as high-speed tool steel in the shape of a circular column as a whole, and has a seat portion 65, a pressure receiving surface 61, a spring housing portion 62, a needle sliding portion 63, and a collar member 67. The seat portion 65 is formed on an end portion, which is one of both end portions in the axial direction of the nozzle needle 60 and is arranged opposite to the pressure control chamber 53, and is seated on the valve seat portion 45 of the control body 40. Furthermore, the seat portion 65 constructs a valve portion 50 together with the valve seat portion 45, such that the valve portion 50 allows and interrupts the flow of the high-pressure fuel supplied into the nozzle needle housing portion 43 to the nozzle holes 44.

The pressure receiving surface 61 is formed of an end portion, which is one of both end portions in the axial direction of the nozzle needle 60, and is arranged at a side of the pressure control chamber 53, opposite to the seat portion 65. Furthermore, the pressure receiving surface 61 partitions the pressure control chamber 53 together with the abutting surface 90 and the cylindrical wall portion 57 and receives the pressure of the fuel in the pressure control chamber 53.

The spring housing portion 62 is a cylindrical hole formed coaxially with the nozzle needle 60 in the central portion in the radial direction of the pressure receiving surface 61. The spring housing portion 62 houses a portion of a plate spring 76.

The needle sliding portion 63 is a portion of the circular column-shaped outer peripheral wall of the nozzle needle 60 and is located closer to the pressure receiving surface 61 than the cylindrical wall portion 57. The needle sliding portion 63 is supported in such a way as to freely slide with respect to the cylinder sliding portion 59 formed by the inner peripheral wall of the cylinder 56.

The collar member 67 is a ring-shaped member fitted on the outer peripheral wall portion of the nozzle needle 60 and is held by the nozzle needle 60.

The nozzle needle 60 is biased to the side of the valve portion 50 by a return spring 66. The return spring 66 is a coil spring made by winding a metal wire in the shape of a circle. The return spring 66 has one end in the axial direction seated on a face on the pressure control chamber 53 side of the collar member 67 and has the other end seated on an end surface on the valve portion side of the cylinder 56, respectively.

According to the structure described above, the nozzle needle 60 is reciprocally displaced in a linear manner in the axial direction of the cylinder 56 with respect to the cylinder 56 in response to the pressure applied to the pressure receiving surface 61, that is, the pressure of the fuel in the pressure control chamber 53 to seat the seat portion 65 on the valve seat portion 45 or to separate the seat portion 65 from the valve seat portion 45, thereby closing or opening the valve portion 50.

The floating plate 70 is a member made of a metal material in the shape of a circular disk and has a pressing surface 86 and a communication hole 71. The floating plate 70 is arranged in such a way to be reciprocally displaced in the pressure control chamber 53 and has its displacement axis direction arranged along the axial direction of the cylinder 56. In addition, the floating plate 70 is arranged coaxially with the cylinder 56.

Of both end surfaces 73*a*, 73*b* in the displacement axis direction of the floating plate 70, the end surface 73*a* opposite to the abutting surface 90 in the displacement axis direction forms the pressing surface 86. When the floating plate 70 is reciprocally displaced, the pressing surface 86 abuts on the abutting surface 90. The communication hole 71 extends from the central portion of the pressing surface 86 along the displacement axis direction of the floating plate 70.

When the pressing surface 86 of the floating plate 70 abuts on the abutting surface 90, the communication hole 71 becomes a fuel channel that makes the pressure control chamber 53 communicate with the outflow channel 54. The communication hole 71 has a narrowed portion 71*a* (throttle portion) and a communication depressed portion 71*b*.

The narrowed portion 71*a* narrows the channel area of the communication hole 71 to regulate the flow amount of the fuel flowing through the communication hole 71. The narrowed portion 71*a* is closer to the end surface 73*a*, which is one of both end surfaces 73*a*, 73*b* in the axial direction of the floating plate 70 and forms the pressing surface 86, than the end surface 73*b* opposite to the pressure receiving surface 61.

In the communication depressed portion 71*b*, of a pair of openings of the communication hole 71, one opening formed in the end surface 73*b* is made large. On the other hand, the end surface 73*b* opposite to the pressing surface 86 in the displacement axis direction is biased by the plate spring 76.

The plate spring 76 is a coil spring made by winding a metal wire in the shape of a circle. The plate spring 76 has one end in the axial direction seated on the end surface 73*b* of the floating plate 70. The plate spring 76 has the other end in the axial direction housed in the spring housing portion 62 of the nozzle needle 60. The plate spring 76 is arranged between the floating plate 70 and the nozzle needle 60 coaxially with them and in a contracted state in the axial direction.

According to the structure described above, the plate spring 76 biases the floating plate 70 to the abutting surface 90 side with respect to the nozzle needle 60. Even when a pressure difference between the end surface 73*a* and the end surface 73*b* in the axial direction of the flowing plate 70 is small, the floating plate 70 is biased to the abutting surface 90 side by the biasing force of the plate spring 76 to make the pressing surface 86 abut on the abutting surface 90.

Figure 4:
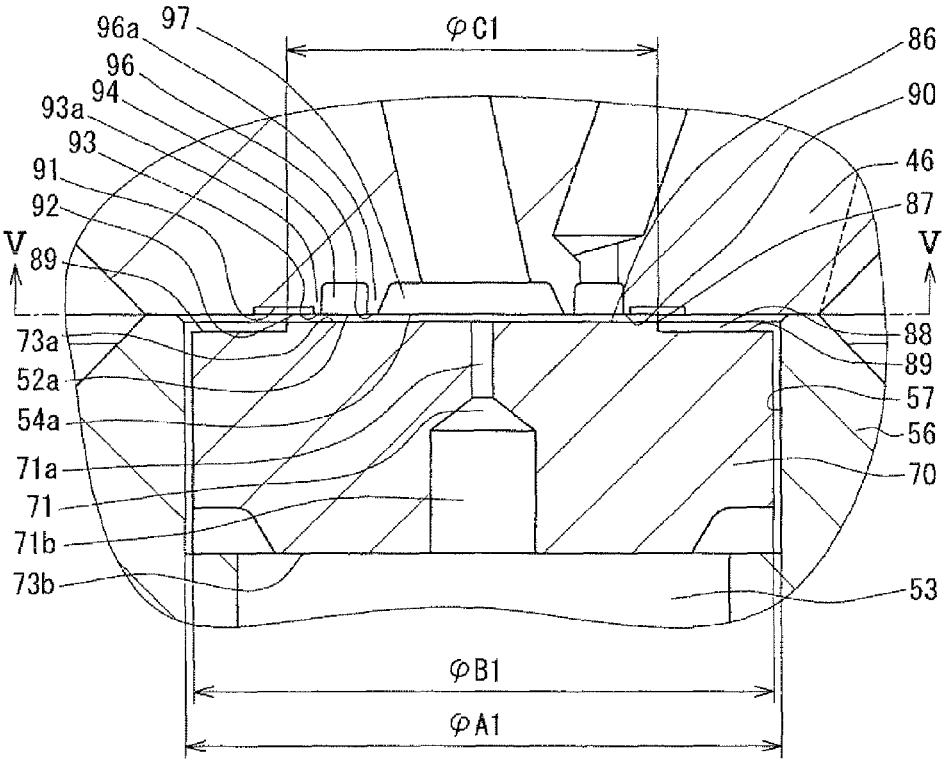
FIG. 4 is an enlarged view showing the portion of the fuel injection device shown in FIG. 3, according to the first embodiment of the present invention.
Figure 5:
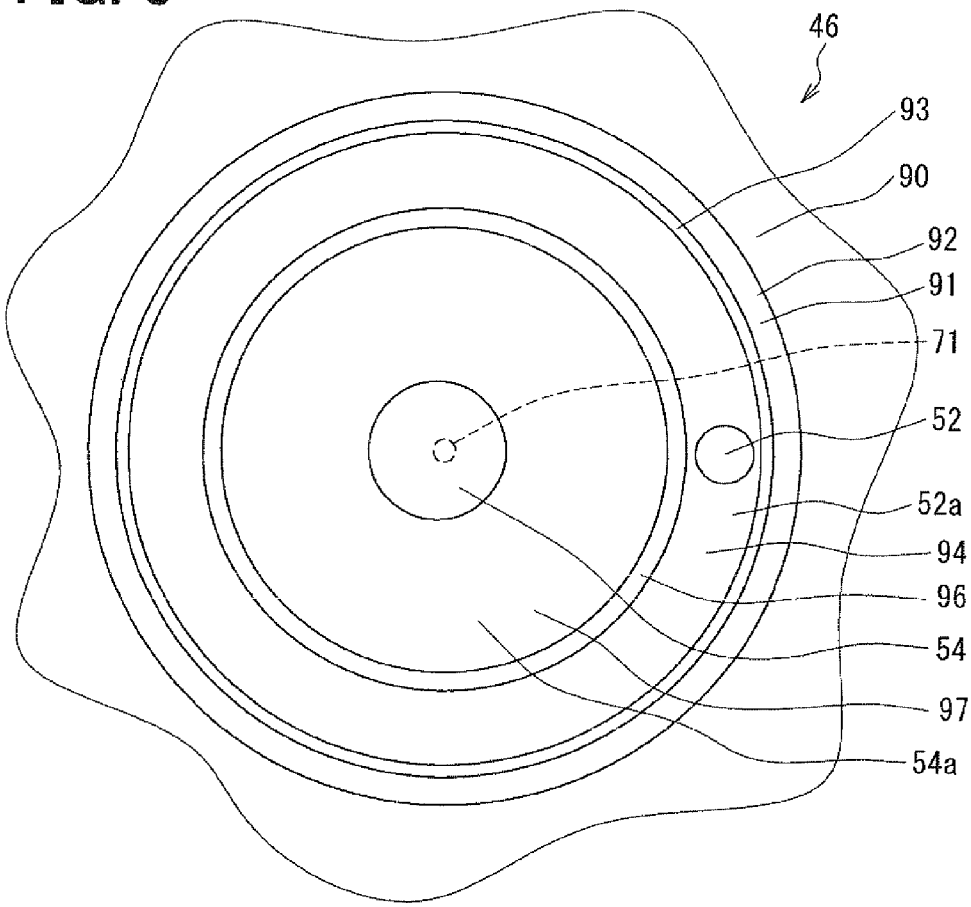
FIG. 5 is a view when being viewed from a direction shown by an arrow V in FIG. 4, to illustrate the shapes and the arrangement of a ring-shaped depressed portion (special depressed portion), an inflow depressed portion, and an outflow depressed portion that are formed in an abutting surface.
Figure 6:
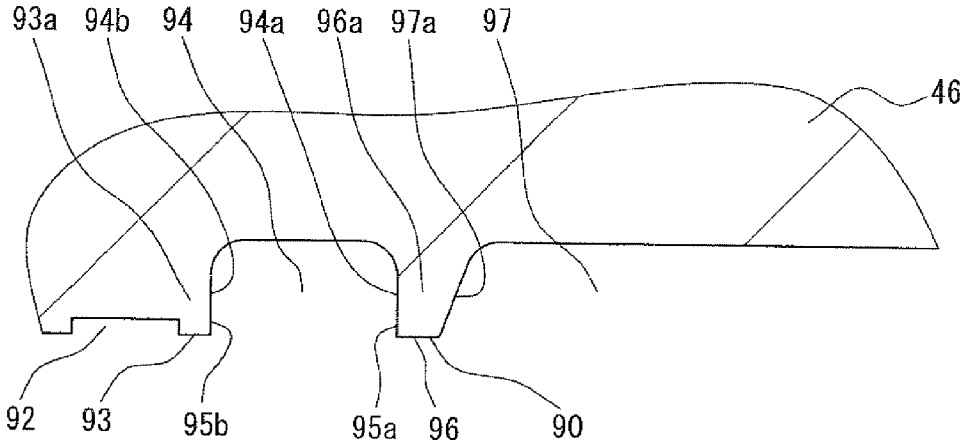
FIG. 6 is an enlarged view showing a portion of a valve body near a ring-shaped depressed portion (special depressed portion) according to the first embodiment.

Next, the fuel injection device 100 will be further described in detail on the basis of FIG. 4 to FIG. 6.

An outermost diameter ϕB1 (see FIG. 4) of the floating plate 70 is made smaller than an inner diameter ϕA1 (see FIG. 4) of the cylindrical wall portion 57 of the cylinder 56. A clearance is produced between the cylinder 56 and the floating plate 70 by a difference between the inner diameter ϕA1 of the cylinder 56 and the outermost diameter ϕB1 of the floating plate 70. The floating plate 70 can be displaced reciprocally and smoothly in the pressure control chamber 53 by using the clearance. In addition, the fuel flowing into the pressure control chamber 53 from the inflow port 52*a* can pass through the clearance and can move to the end surface 73*b* of the floating plate 70.

Among the abutting surface 90, an outer edge opposite surface portion 91 opposite to an outer edge 87 of the pressing surface 86 in the displacement axis direction of the floating plate 70 has a ring-shaped depressed portion 92 (special depressed portion) depressed in the displacement axis direction. The ring-shaped depressed portion 92 extends in the shape of a circular ring along the shape of the outer edge 87 of the pressing surface 86.

The inflow depressed portion 94 and the outflow depressed portion 97 are located on the inner peripheral side of this ring-shaped depressed portion 92. In addition, the ring-shaped depressed portion 92, the inflow depressed portion 94, and the outflow depressed portion 97 are the special depressed portions provided independently from each other, and are concentric with each other (see FIG. 5).

According to the structure described above, in the abutting surface 90, the ring-shaped depressed portion 92 and the inflow depressed portion 94 are connected to each other by a connecting surface portion 93, and the inflow depressed portion 94 and the outflow depressed portion 97 are connected to each other by a connecting surface portion 96. Each of the connecting surface portions 93, 96 is formed in the shape of a circular ring.

The width in the radial direction of the ring-shaped depressed portion 92 is larger than a difference between the inner diameter ϕA1 of the cylindrical wall portion 57 and the outermost diameter ϕB1 of the floating plate 70. In addition, the depth of the ring-shaped depressed portion 92 is made smaller than the depth of the inflow depressed portion 94.

In addition, a peripheral wall surface 97*a* of the outflow depressed portion 97 is inclined inward in the radial direction toward the bottom side of the outflow depressed portion 97 (see FIG. 6). In a peripheral wall surface 94*a* on the inner peripheral side and a peripheral wall surface 94*b* on the outer peripheral side of the inflow depressed portion 94, continuing surface portions 95*a*, 95*b* continuing to the abutting surface 90 are formed along the displacement axis direction of the floating plate 70.

The reason why the continuing surface portions 95*a*, 95*b* are formed along the displacement axis direction in this manner is that when the valve body 46 is manufactured, the end surface of the valve body 46 is cut in the axial direction to thereby finish the abutting surface 90. Specifically, since the continuing surface portions 95*a*, 95*b* are formed along the axial direction of the valve body 46, the width in the radial direction of the inflow depressed portion 94 and the position of the inflow depressed portion 94 in the abutting surface 90 are hard to be varied in the radial direction by the amount at which the end surface of the valve body 46 is cut.

The floating plate 70 has a reduced diameter portion 89 formed outside in the radial direction of the pressing surface 86, and the reduced diameter portion 89 has the outer diameter of the pressing surface 86 reduced with respect to the outermost diameter ϕB1 of the floating plate 70. The outer diameter ϕC1 (see FIG. 4) of the outer edge 87 of the pressing surface 86 is reduced with respect to the outermost diameter ϕB1 of the floating plate 70 by this reduced diameter portion 89. The reduced diameter portion 89 extends in the shape of a circular ring around the displacement axis of the floating plate 70.

In a state where the pressing surface 86 abuts on the abutting surface 90, a circular ring-shaped cutout space 88 is formed outside in the radial direction of the pressing surface 86 by the shape of the reduced diameter portion 89. The reduced diameter portion 89 is formed, specifically, by depressing the outer peripheral wall surface of the floating plate 70, which continues to the end surface 73*a* forming the pressing surface 86, toward the end surface 73*a*. A step is formed on the outer peripheral side of the pressing surface 86 by this shape.

An operation that the fuel injection device 100 configured in the above-described opens and closes the valve portion 50 in response to a control signal from the engine control device 17 to inject the fuel will be described below on the basis of FIG. 2 to FIG. 4.

The magnetic field generated by the solenoid 31 in response to the pulse current of the engine control device 17 opens the pressure control valve 80. The operation of the pressure control valve 80 makes the outflow port 54*a* communicate with the return channel 14*f*, so that the fuel flows out of the pressure control chamber 53 through the outflow channel 54 and the longitudinal hole 48*b*.

Thus, firstly, pressure near the outflow port 54*a* can be reduced in the pressure control chamber 53, whereby the floating plate 70 is drawn toward the abutting surface 90, and the floating plate 70 has pressure applied to the end surface 73*b* by the fuel in the pressure control chamber 53. In addition, the floating plate 70 has the biasing force of the plate spring 76 applied thereto from the end surface 73*b* side.

The reduction in pressure near the outflow port 54*a* and the biasing force of the plate spring 76 more strongly presses the pressing surface 86 abutting on the abutting surface 90 of the valve body 46 onto the abutting surface 90.

When the pressing surface 86 of the floating plate 70 presses the abutting surface 90 in this manner, the communication between the inflow port 52*a* opened in the abutting surface 90 and the pressure control chamber 53 are interrupted. Then, in the pressure control chamber 53 in which the inflow of the fuel from the inflow port 52*a* is interrupted, a rapid reduction in pressure is caused by the outflow of the fuel passing through the communication hole 71.

The rapid reduction in pressure in the pressure control chamber 53 makes the force that the seat portion 65 and the like mainly receives from the fuel in the nozzle needle housing portion 43 larger than the total of the force that the pressure receiving surface 61 receives from the fuel in the pressure control chamber 53 and the biasing force of the return spring 66. Thus, the nozzle needle 60 having this difference in the force applied thereto is pressed up to the side of the pressure control chamber 53 at a high speed.

The nozzle needle 60 displaced to the side of the pressure control chamber 53 separates the seat portion 65 from the valve seat portion 45 to bring the valve portion 50 into an open state.

In the state where the inflow port 52*a* is made to communicate with the return channel 14*f* by the pressure control valve 80, the connecting surface portion 93 of the abutting surface 90 from the inflow depressed portion 94 to the ring-shaped depressed portion 92 and the connecting surface portion 93 of the abutting surface 90 from the outflow depressed portion 97 to the inflow depressed portion 94 abut on the pressing surface 86.

At this time, the ring-shaped depressed portion 92 always strides over the outer edge 87 of the pressing surface 86 in the radial direction. That is, the ring-shaped depressed portion 92 extends in the radial direction from the radial inner side of the outer edge 87 of the pressing surface 86 to the radial outer side of the outer edge 87 of the pressing surface 86.

Specifically, the peripheral wall surface on the inner peripheral side of the ring-shaped depressed portion 92 is located more inside in the radial direction than the outer edge 87 of the pressing surface 86. In addition, the peripheral wall surface on the outer peripheral side of the ring-shaped depressed portion 92 is located more outside in the radial direction than the outer edge 87 of the pressing surface 86.

According to the above-described structure, the width in which the pressing surface 86 is brought into contact with the abutting surface 90 on the outer peripheral side of the inflow depressed portion 94 becomes the width in the radial direction of the connecting surface portion 93. Thus, even if the floating plate 70 is displaced along the abutting surface 90 to shift the position at which the pressing surface 86 abuts on the abutting surface 90, the width is not increased or decreased.

In addition, the width in which the pressing surface 86 is brought into contact with the abutting surface 90 on the inner peripheral side of the inflow depressed portion 94 becomes the width in the radial direction of the connecting surface portion 96. Thus, even if the floating plate 70 is displaced along the abutting surface 90 to shift the position at which the pressing surface 86 abuts on the abutting surface 90, the width is not increased or decreased.

The high-pressure fuel flowing into the inflow depressed portion 94 through the inflow channel 52 applies pressure to the floating plate 70 in a direction to press down the floating plate 70.

When the magnetic field generated by the solenoid 31 in response to the pulse current of the engine control device 17 is destroyed, the pressure control valve 80 is closed. Thus, the communication between the outflow port 54*a* and the return channel 14*f* is interrupted, thereby stopping the outflow of the fuel through the outflow channel 54 and the longitudinal hole 48*b*.

When the fuel passing through the communication hole 71 flows into the outflow depressed portion 97, the force that is applied to the floating plate 70 to press the pressing surface 86 onto the abutting surface 90 is mainly the biasing force by the plate spring 76. Then, the floating plate 70 is pressed down toward the nozzle needle 60 by the pressure of the high-pressure fuel filled in the inflow depressed portion 94.

When the floating plate 70 is displaced to start to separate the pressing surface 86 from the abutting surface 90, the fuel in the inflow depressed portion 94 enters between the connecting surface portion 93 and the connecting surface portion 96 of the abutting surface 90, and the pressing surface 86, to eliminate the close contact between them. As described above, the width in which the pressing surface 86 is brought into contact with the connecting surface portion 93 and the width in which the pressing surface 86 is brought into contact with the connecting surface portion 96 are not increased or decreased by a shift in the position in which the pressing surface 86 abuts on the abutting surface 90. Thus, a variation in the time required for the close contact between the pressing surface 86 and the abutting surface 90 to be eliminated by the fuel in the inflow depressed portion 94 can be prevented.

Accordingly, a variation in the timing at which the floating plate 70 starts to be displaced, after the outflow of the fuel from the outflow port 54*a* to the return channel 14*f* is interrupted by the pressure control valve 80, can be reduced.

When the floating plate 70 is displaced to the side of the nozzle needle 60, the inflow port 52*a* is again opened to the pressure control chamber 53, whereby the inflow of the fuel from the inflow channel 52 is started again. The fuel flowing into the pressure control chamber 53 from the inflow channel 52 passes through the clearance between the floating plate 70 and the cylinder 56 to rapidly increase the pressure in the pressure control chamber 53.

A rapid increase in the pressure in the pressure control chamber 53 again makes the total of the receiving force of the pressure receiving surface 61 received from the fuel in the pressure control chamber 53, and the biasing force of the return spring 66, to be larger than the receiving force of the seat portion 65 and the like mainly received from the fuel in the nozzle needle housing portion 43. Thus, the nozzle needle 60 is pressed down toward the pressure control valve 80 at a high speed.

Then, the seat portion 65 of the nozzle needle 60 seats on the valve seat portion 45 to bring the valve portion 50 into a closed state.

According to the first embodiment described above, even if the floating plate 70 is displaced along the abutting surface 90 to cause a shift in the position in which the pressing surface 86 abuts on the abutting surface 90, a variation in the timing, at which the floating plate 70 starts to be displaced, can be reduced. Thus, it is possible to stably set the state in which the pressure in the pressure control chamber 53 is increased after the outflow of the fuel from the outflow port 54*a* to the return channel 14*f* is interrupted by the pressure control valve 80.

According to the above description, a variation in the timing at which the valve portion 50 is closed by the nozzle needle 60 can be prevented. Thus, in the fuel injection device 100, the amount of fuel injected from the nozzle injection holes 44 is hard to vary, which results in improving injection accuracy.

Since the outer edge 87 of the pressing surface 86 is located in the ring-shaped depressed portion 92 in the radial direction, the contact area of the pressing surface 86 and the abutting surface 90 is decreased. Thus, the state in which the pressing surface 86 is in contact with the abutting surface 90 can be easily eliminated, so that the time required for the close contact between the pressing surface 86 and the abutting surface 90 to be eliminated can be shortened.

As described above, the responsiveness with which floating plate 70 is separated from the abutting surface 90 can be enhanced. Thus, this can make the fuel injection device 100 having an improvement not only in the injection accuracy but also in the responsiveness when the valve is closed.

In addition, according to the first embodiment, the circular disk-shaped floating plate 70 can be displaced in a direction along the abutting surface 90 by a difference between the inner diameter ϕA1 of the cylindrical wall portion 57 and the outermost diameter ϕB1 of the floating plate 70. Thus, when the width in the radial direction of the ring-shaped depressed portion 92 is made larger than the difference between the inner diameter ϕA1 of the cylindrical wall portion 57 and the outermost diameter ϕB1 of the floating plate 70, the ring-shaped depressed portion 92 can extend radially over the outer edge 87 of the pressing surface 86.

As described above, the ring-shaped depressed portion 92 surely allows the shift in the position of the outer edge 87 of the pressing surface 86 to be caused along the abutting surface 90, so that an increase or a decrease in the contact width of the pressing surface 86 and the abutting surface 90 on the outer peripheral side of the inflow depressed portion 94 can be surely prevented. Thus, a variation in the time required for the close contact between the pressing surface 86 and the abutting surface 90 to be eliminated can be prevented with reliability.

According to the first embodiment, both of the connecting surface portion 93 and the connecting surface portion 96 which are brought into contact with the pressing surface 86 on the outer peripheral side and the inner peripheral side of the inflow depressed portion 94 are formed in the shape of a circular ring. Thus, the contact width in which the abutting surface 90 is brought into contact with the pressing surface 86 is made constant along the peripheral direction. In addition, the inflow depressed portion 94 is formed in the shape of a circular ring.

According to the above-described structure, the close contact between the connecting surface portions 93, 96 and the pressing surface 86 can be eliminated uniformly in the peripheral direction by the fuel entering between the connecting surface portions 93, 96 and the pressing surface 86 from the inflow depressed portion 94 formed in the shape of the circular ring. Thus, when the floating plate 70 starts to be displaced, the problem that the displacement axis direction of the floating plate 70 is inclined with respect to the axial direction of the cylinder 56 can be prevented.

According to the structure described above, when the floating plate 70 starts to be displaced, the behavior of the floating plate 70 can be made stable, so that a variation in the timing, at which the floating plate 70 starts to be displaced, can be further reduced.

According to the first embodiment, the continuing surface portion 95*a* and the continuing surface portion 95*b* (see FIG. 6) are formed along the displacement axis direction of the floating plate 70.

According to the shapes of the peripheral wall surfaces 94*a*, 94*b* on the inner peripheral side and the outer peripheral side of the inflow depressed portion 94, even if the pressing surface 86 presses the abutting surface 90 to wear the abutting surface 90 in the displacement axis direction, the positions in the radial direction of the continuing surface portions 95*a*, 95*b* of these peripheral wall surfaces 94*a*, 94*b* are not shifted. Thus, even if the abutting surface 90 is repeatedly pressed by the pressing surface 86 and hence is worn along the displacement axis direction of the floating plate 70, the position in which the inflow depressed portion 94 is depressed in the abutting surface 90 and the width in the radial direction of the inflow depressed portion 94 are not changed.

According to the above-described structure, even if the abutting surface 90 is worn, the force that the floating plate 70 receives from the fuel in the inflow depressed portion 94 when the floating plate 70 starts to be displaced is hard to vary. Thus, the behavior of the floating plate 70 when the inflow port 52*a* is made to communicate with the pressure control chamber 53 can be made stable for a long time.

In addition, according to the first embodiment, the pressure in the outflow depressed portion 97 into which the fuel flows from the inflow channel 52 can be made higher than the pressure in the ring-shaped depressed portion 92 communicating with the pressure control chamber 53. Thus, the wall portion 93*a* adapted to separate the inflow depressed portion 94 from the ring-shaped depressed portion 92 needs to have strength large enough to resist a difference between the pressure in inflow depressed portion 94 and the pressure in the ring-shaped depressed portion 92.

Accordingly, when the depth of the ring-shaped depressed portion 92 is made smaller than the depth of the inflow depressed portion 94 to ensure a thickness on the bottom side of the inflow depressed portion 94 in the wall portion 93*a*, the strength of the wall portion 93*a* can be enhanced. On the other hand, when the depth of the inflow depressed portion 94 is made large, the area of a channel for making the high-pressure fuel supplied through the inflow channel 52 flow in the peripheral direction through the inflow depressed portion 94 can be ensured. Thus, the high-pressure fuel required to press down the floating plate 70 can be reliably made to flow in the inflow depressed portion 94.

In addition, according to the first embodiment, the peripheral wall portion 97*a* of the outflow depressed portion 97 (see FIG. 6) is inclined inward in the radial direction toward the bottom side of the outflow depressed portion 97. Therefore, the wall portion 96*a* adapted to separate the outflow depressed portion 97 from the inflow depressed portion 94 has its width increased on the bottom side of the outflow depressed portion 97. Thus, this can enhance the strength of the wall portion 96*a* that separates the outflow depressed portion 97 from the inflow depressed portion 94.

Furthermore, according to the first embodiment, the reduced diameter portion 89 that reduces the outer diameter ϕC1 of the outer edge 87 of the pressing surface 86 with respect to the outermost diameter ϕB1 of the floating plate 70 is formed outside in the radial direction of the pressing surface 86. In this floating plate 70, the pressing surface 86 is formed in the end surface 73*a* in the displacement axis direction of the floating plate 70 and in a concentrated manner in the central portion in the radial direction of the end surface 73*a*.

When the pressing surface 86 is formed in the concentrated manner in the central portion of the end surface 73*a* in this manner, even if the axial direction of the floating plate 70 is inclined with respect to the correct displacement axis direction, the pressure developed between the pressing surface 86 and the abutting surface 90 can be easily made uniform over the entire face. Thus, it can prevent the fuel from leaking between the pressing surface 86 and the abutting surface 90 and hence can acquire the floating plate 70 capable of reliably interrupting the communication between the inflow port 52*b* and the pressure control chamber 53.

Furthermore, since the pressing surface 86 is formed in the concentrated manner in the central portion of the end surface 73*a* by the reduced diameter portion 89, the area of the pressing surface 86 can be reduced. Thus, it can reduce the contact area of the pressing surface 86 and the abutting surface 90 and hence can produce a higher contact pressure between the pressing surface 86 and the abutting surface 90. Accordingly, the communication between the inflow port 52*b* and the pressure control chamber 53 can be interrupted more reliably by the floating plate 70.

In addition, since the pressing surface 86 is formed in the concentrated manner in the central portion of the end surface 73*a* by the reduced diameter portion 89, the inflow depressed portion 94 can be reduced in the radial direction and hence the area of the inflow port 52*a* can be decreased. Thus, the force that is applied to the floating plate 70 by the fuel in the inflow depressed portion 94 and that presses down the floating plate 70 is decreased. As a result, the contact pressure developed between the pressing surface 86 and the abutting surface 90 can be increased with more reliability.

As described above, since the contact pressure developed between the pressing surface 86 and the abutting surface 90 is increased, the floating plate 70 can interrupt the communication between the inflow port 52*a* and the pressure control chamber 53 with reliability and can contribute to an improvement in the injection accuracy of the fuel injection device 100.

In the first embodiment, the nozzle needle 60 is an example of a valve member for opening and closing the valve portion 50, and the floating plate 70 is an example of a pressing member reciprocally displaced in the pressure control chamber 53.

Second Embodiment

Figure 7:
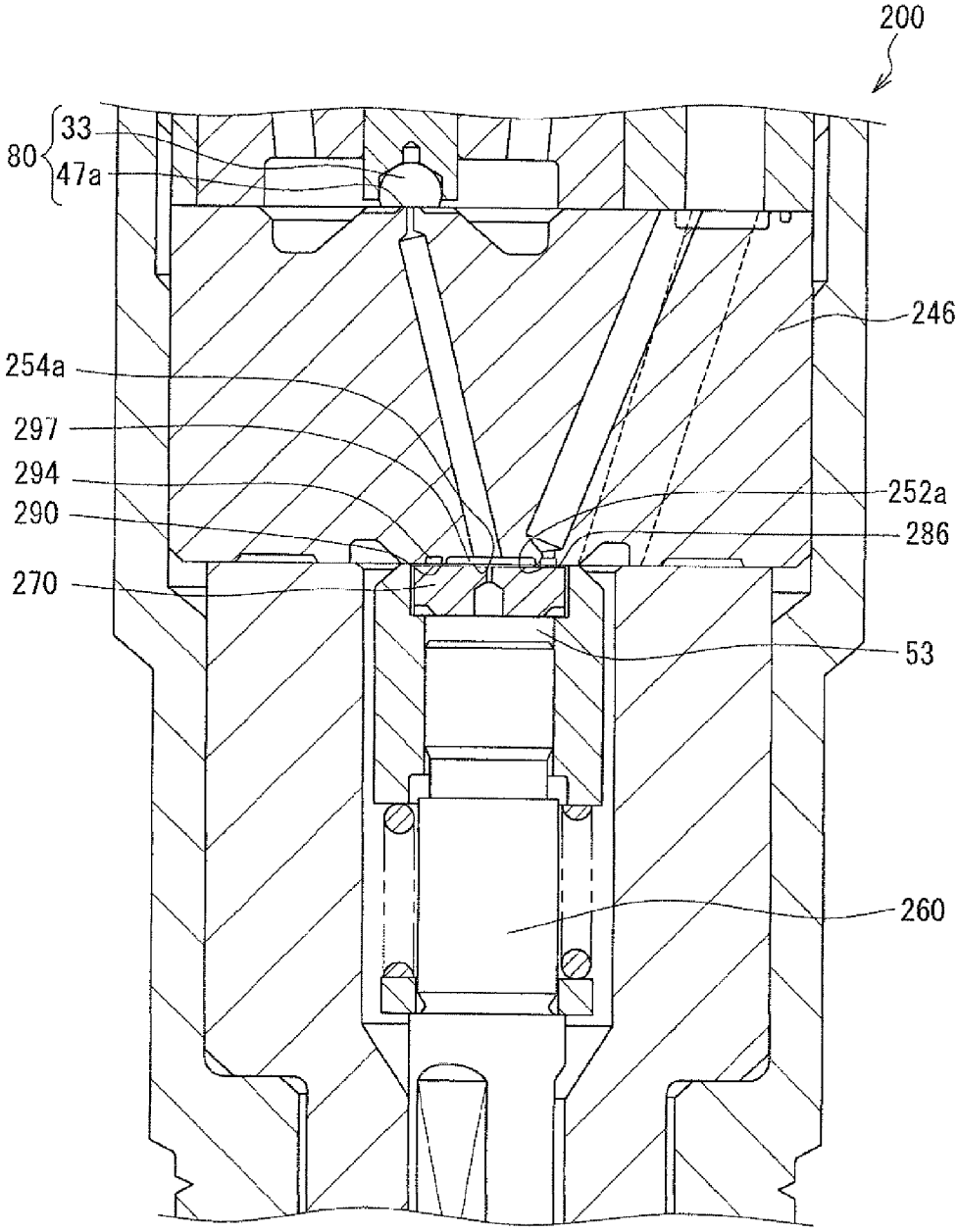
FIG. 7 is a view to show a modification of FIG. 3, according to a second embodiment of the invention.
Figure 8:
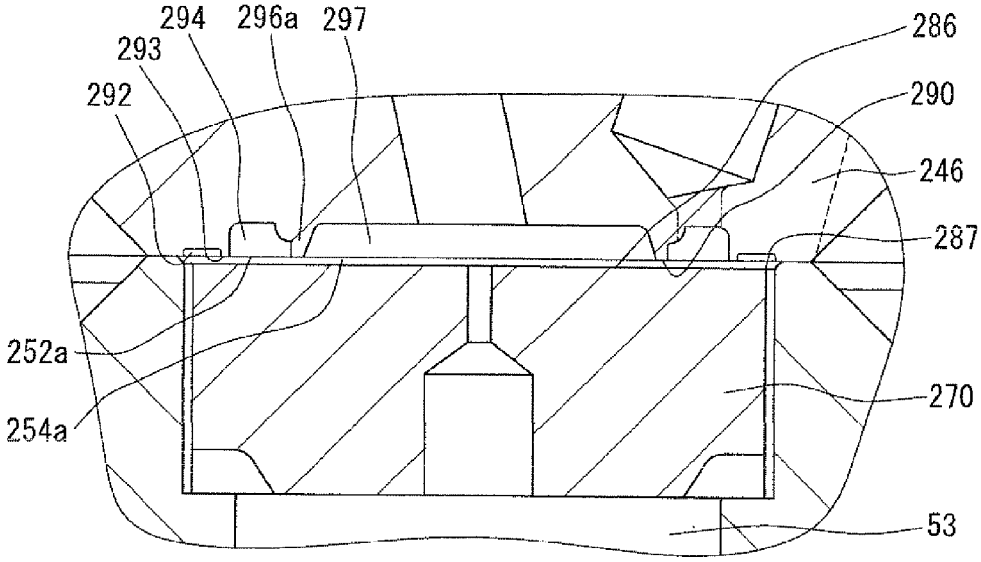
FIG. 8 is a view to show a modification of FIG. 4, according to the second embodiment of the invention.
Figure 9:
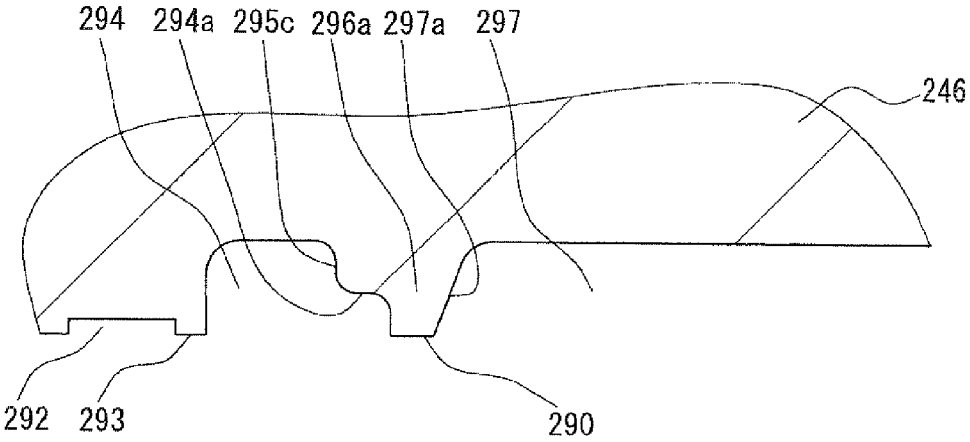
FIG. 9 is a view to show a modification of FIG. 6, according to the second embodiment of the invention.

A second embodiment of the present invention shown in FIG. 7 to FIG. 9 is a modification of the first embodiment.

A fuel injection device 200 of the second embodiment has a nozzle needle 260, a valve body 246, and a floating plate 270 that correspond to the nozzle needle 60, the valve body 46, and the floating plate 70 of the first embodiment, respectively. In addition, in the fuel injection device 200, a structure corresponding to the plate spring 76 in the first embodiment is omitted. Hereinafter, the structure of the fuel injection device 200 according to the second embodiment will be described in detail.

First, in the nozzle needle 260, a cylindrical hole corresponding to the spring housing portion 62 is omitted because the plate spring 76 is omitted.

As shown in FIG. 8, the valve body 246 has a ring-shaped depressed portion 292 (special depressed portion), an inflow depressed portion 294, and an outflow depressed portion 297 that correspond to the ring-shaped depressed portion 92, the inflow depressed portion 94, and the outflow depressed portion 97 in the valve body 46 of the first embodiment, respectively.

The ring-shaped depressed portion 292, the inflow depressed portion 294, and the outflow depressed portion 297 in the valve body 246 are enlarged in the radial direction of the abutting surface 290. The inflow depressed portion 294 and the outflow depressed portion 297 form and define an inflow port 252*a* and an outflow port 254*a*, respectively. In addition, an inner peripheral wall surface 294*a* of the inflow depressed portion 294 has a stepped surface portion 295*c* as shown in FIG. 9. The stepped surface portion 295*c* reducing the width in the radial direction of the inflow depressed portion 294 toward the bottom portion thereof, as shown in FIG. 9.

As in the peripheral wall surface 97*a* of the first embodiment, a peripheral wall surface 297*a* of the outflow depressed portion 297 is inclined inward in the radial direction toward the bottom side of the outflow depressed portion 297, as shown in FIG. 9.

The floating plate 270 does not have the reduced diameter portion 89 and the cutout space 88 formed by the reduced diameter portion 89 in the floating plate 70 of the first embodiment. Thus, the diameter of an outer edge 287 of a pressing surface 286 in the floating plate 270 is equal to the outer diameter of the floating plate 270. The outer edge 287 of this pressing surface 286 is opposite to the ring-shaped depressed portion 292 in the displacement axis direction.

In the fuel injection device 200 of the second embodiment, in the state in which the communication of the inflow port 252*a* and the return channel 14*f* (see FIG. 1) is interrupted, the pressing surface 286 of the floating plate 270 is separated from an abutting surface 290 of the valve body 246.

When the inflow port 252*a* is made to communicate with the return channel 14*f* (see FIG. 1), the floating plate 270 receives pressure from the fuel in the pressure control chamber 53*a*, thereby being displaced toward the abutting surface 290.

The floating plate 270 makes the pressing surface 286 abut on the abutting surface 290 and then presses the abutting surface 290 by the pressing surface 286 to interrupt the communication between the inflow port 252*a* and the pressure control chamber 53. At this time, the ring-shaped depressed portion 292 opposite to the outer edge 287 of the pressing surface 286 always extends over the outer edge 287 in the radial direction.

Thus, even if the floating plate 270 is displaced along the abutting surface 290 to shift the position where the pressing surface 286 abuts on the abutting surface 290, the width in which the pressing surface 286 is brought into contact with the abutting surface 290 on the outer peripheral side of the inflow depressed portion 294 becomes the width in the radial direction of a connection surface portion 293 and hence is not increased or decreased.

When the floating plate 270 is displaced to start to separate the pressing surface 286 from the abutting surface 290, the fuel in the inflow depressed portion 294 enters between the connection surface portion 293 and the pressing surface 286 to eliminate the close contact between them.

Since the contact with of the pressing surface 286 and the connection surface portion 293 is not increased or decreased by a shift in the position where the pressing surface 286 abuts on the abutting surface 290, it can reduce a variation in the time required for eliminating the close contact between the pressing surface 286 and the abutting surface 290 by using the fuel in the inflow depressed portion 294.

Thus, in the second embodiment, it is possible to reduce a variation in the timing at which the floating plate 270 starts to be displaced, after the flow of the fuel from the outflow port 254*a* to the return channel 14*f* (see FIG. 1) is interrupted by the pressure control valve 80. Therefore, the pressure in the pressure control chamber 53 can be stably increased.

According to the above-described second embodiment, a variation in the timing at which the valve portion 50 (see FIG. 2) is closed by the nozzle needle 260 can be prevented. Thus, the injection accuracy of the fuel injection device 200 can be improved.

In addition, in the second embodiment, the inner peripheral wall surface 294*a* of the inflow depressed portion 294 (see FIG. 9) has the stepped surface portion 295*c* formed thereon and the peripheral wall surface 297*a* of the outflow depressed portion 297 is inclined. Thus, a wall portion 296*a* configured to separate the outflow depressed portion 297 from the inflow depressed portion 294 has its width increased on the bottom side of the outflow depressed portion 297. Accordingly, this can enhance the strength of the wall portion 296*a* to separate the outflow depressed portion 297 from the inflow depressed portion 294.

In the second embodiment, the nozzle needle 260 is an example of a valve member for opening and closing the valve portion 50, and the floating plate 270 is an example of a pressing member reciprocally displaced in the pressure control chamber 53.

Third Embodiment

Figure 10:
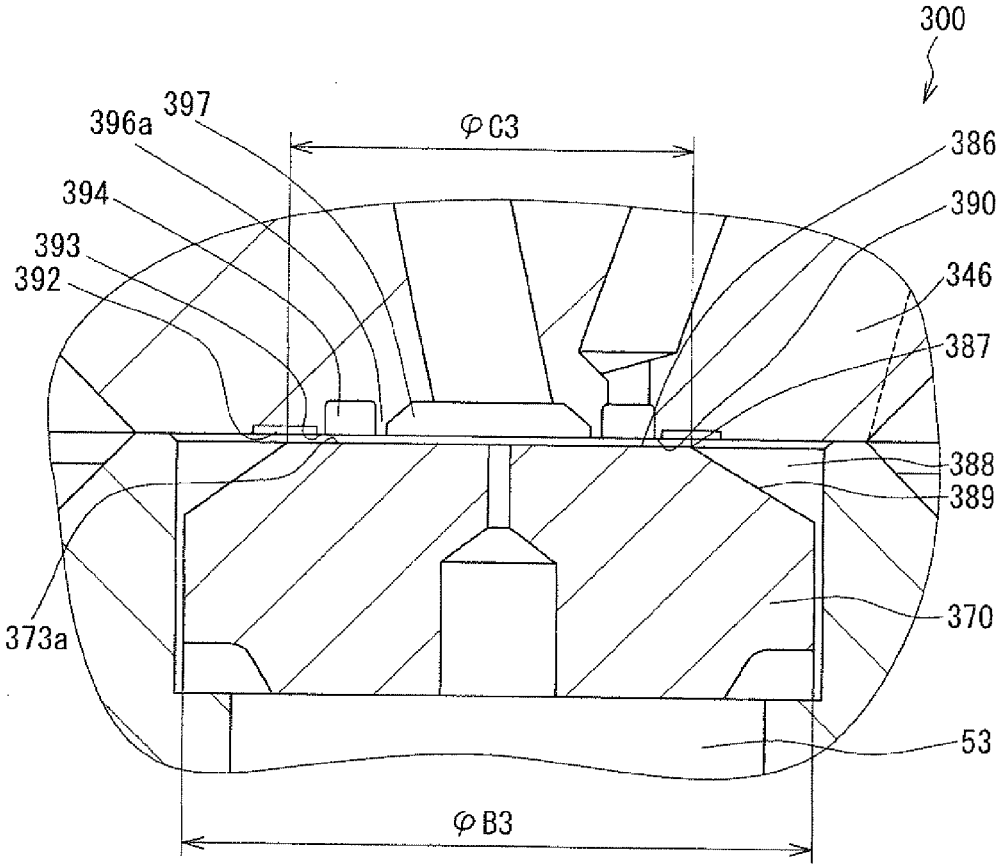
FIG. 10 is a view to show another modification of FIG. 4, according to a third embodiment of the invention.
Figure 11:
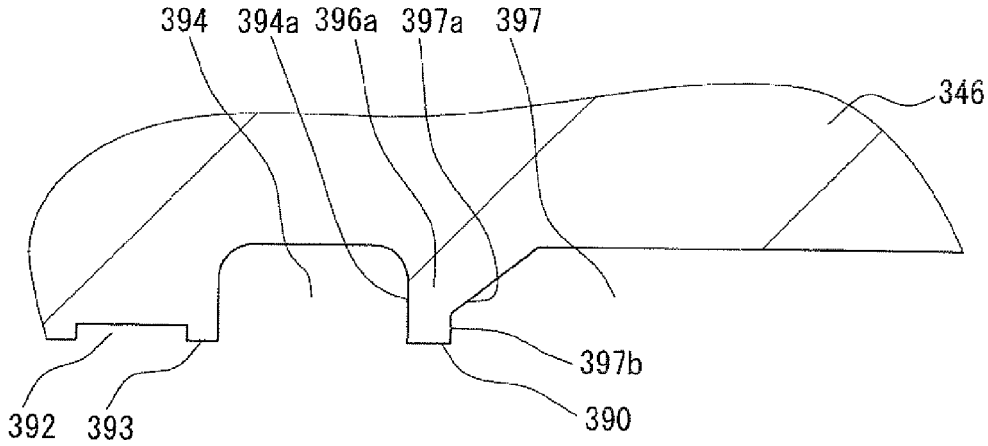
FIG. 11 is a view to show another modification of FIG. 6, according to the third embodiment of the invention.

A third embodiment of the present invention shown in FIG. 10 and FIG. 11 is another modification of the first embodiment.

A fuel injection device 300 of the third embodiment has a floating plate 370 and a valve body 346 that correspond to the floating plate 70 and the valve body 46 of the first embodiment, respectively. Hereinafter, the structure of the fuel injection device 300 according to the third embodiment will be described in detail.

The floating plate 370 in the third embodiment has a reduced diameter portion 389 corresponding to the reduced diameter portion 89 in the floating plate 70 of the first embodiment.

An outer diameter ϕC3 (see FIG. 10) of an outer edge 387 of a pressing surface 386 is reduced with respect to an outermost diameter ϕB3 of the floating plate 370. The reduced diameter portion 389 extends in the shape of a circular ring around the displacement axis of the floating plate 370, By this reduced diameter portion 389, a circular ring-shaped cutout space 388 is formed outside in the radial direction of the pressing surface 386 in the state where the pressing surface 386 abuts on an abutting surface 390.

The reduced diameter portion 389 is inclined inward in the radial direction in the shape of a cone toward an end surface 373*a* that forms the pressing surface 386 and that is located in the displacement axis direction. By the reduced diameter portion 389, the outer edge 387 of the pressing surface 386 is opposed to a ring-shaped depressed portion 392 (special depressed portion) of the abutting surface 390 in the displacement axis direction.

The valve body 346 is different in the shape of a peripheral wail surface 397*a* of an outflow depressed portion 397, as compared with the valve body 46 of the first embodiment. In the peripheral wall surface 397*a* of the outflow depressed portion 397, a continuing surface portion 397*b* continuing to the abutting surface 390 is formed to extend along the displacement axis direction of the floating plate 370. A portion that forms the peripheral wall surface 397*a* and that lies closer to a bottom side of the outflow depressed portion 397 than the continuing surface portion 397*b* is inclined inward in the radial direction toward the bottom side.

On the other hand, as in the case of the continuing surface portion 397*b*, an inner peripheral wall surface 394*a* of an inflow depressed portion 394 is formed along the displacement axis direction of the floating plate 370.

According to the structure of the third embodiment, a wall portion 396*a* configured to separate the outflow depressed portion 397 from the inflow depresses portion 394 has its width increased on the bottom side of the outflow depressed portion 397. Thus, it is possible to increase the strength of the wall portion 396*a* that is configured to separate the outflow depressed portion 397 from the inflow depressed portion 394.

In addition, since the continuing surface portion 397*b* is formed to extend along the displacement axis direction, that is, the axial direction of the valve body 346, even if the abutting surface 390 is worn along the displacement axis direction of the floating plate 370, the diameter of the outflow depressed portion 397 in the abutting surface 390 is not varied.

When the valve body 346 is manufactured, an end surface of the valve body 346 is cut in the axial direction to finish the abutting surface 390, and thereby it can prevent the problem that the diameter of the inflow depressed portion 394 is varied by the amount at which the end surface is cut.

In the third embodiment described above, the reduced diameter portion 389 is formed in such a way as to be inclined in the shape of a cone, so that the ring-shaped depressed portion 392 can stride over the outer edge 387 of the pressing surface 386. That is, the ring-shaped depressed portion 392 extends over from a radial inner side of the outer edge 387 of the pressing surface 386 to a radial outer side of the outer edge 387.

Thus, the contact width in which the abutting surface 390 is brought into contact with the pressing surface 386 on the outer peripheral side of an inflow depressed portion 394 becomes the width in the radial direction of a connecting surface portion 393 to connect the inflow depressed portion 394 and the ring-shaped depressed portion 392, and hence is not increased or decreased by a shift in the position in which the pressing surface 386 abuts on the abutting surface 390.

According to the above-described structure, it can effectively reduce a variation in the time required for eliminating the close contact between the pressing surface 386 and the abutting surface 390, by using the fuel in the inflow depressed portion 394. Thus, the pressure in the pressure control chamber 53 is stably increased and, and thereby it can prevent a variation in the timing at which the valve portion 50 (see FIG. 2) is closed by the nozzle needle 60. As a result, the injection accuracy of the fuel injection device 300 can be improved.

In the third embodiment, the floating plate 370 is an example of the pressing member reciprocally displaced in the pressure control chamber 53.

Fourth Embodiment

Figure 12:
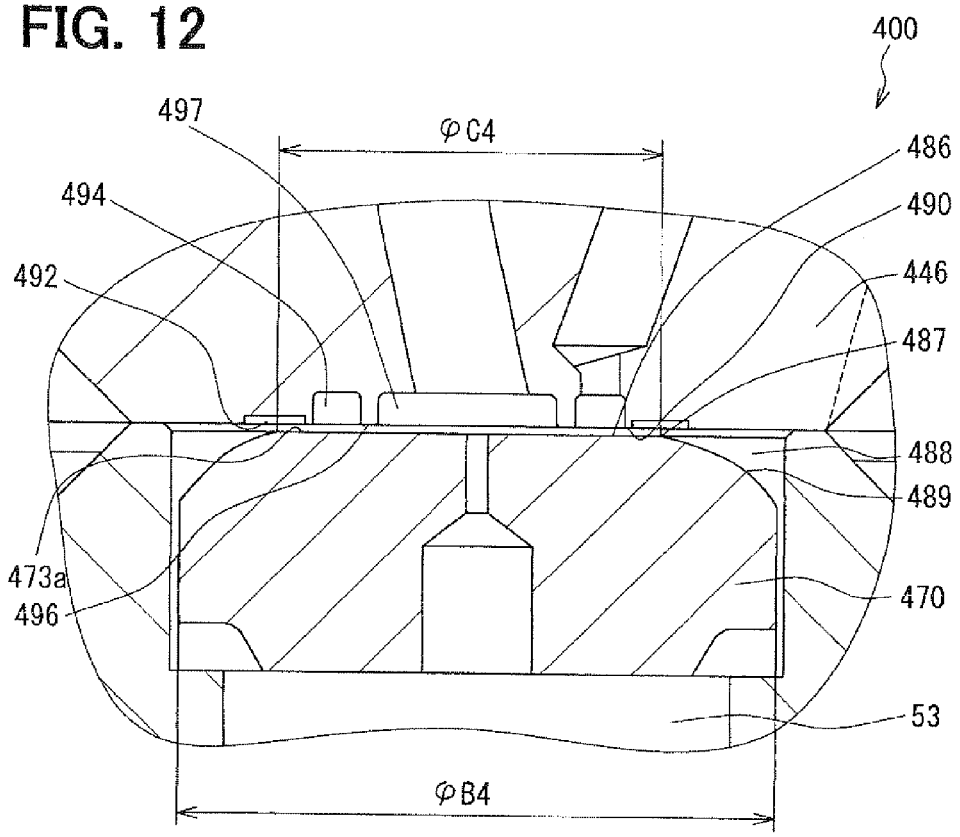
FIG. 12 is a view to show a modification of FIG. 10, according to a fourth embodiment of the invention.
Figure 13:
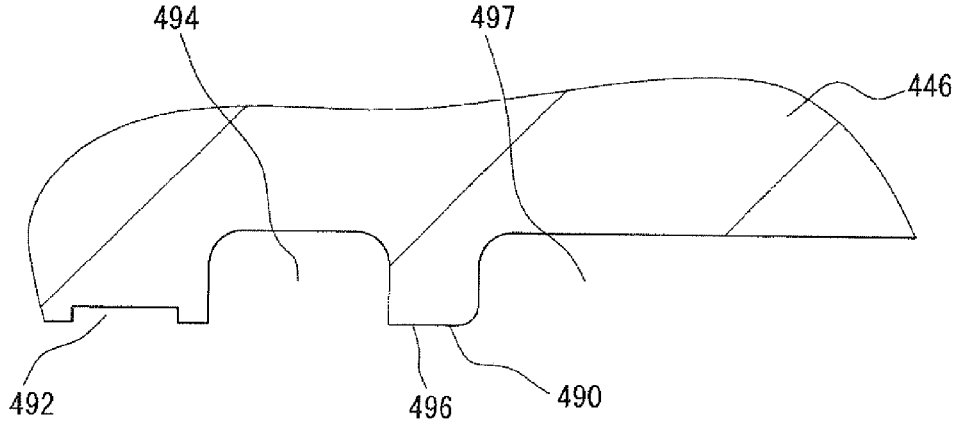
FIG. 13 is a view to show a modification of FIG. 11, according to the fourth embodiment of the invention.

A fourth embodiment of the present invention shown in FIG. 12 and FIG. 13 is a modification of the third embodiment.

A fuel injection device 400 of the fourth embodiment has a floating plate 470 and a valve body 446 that correspond to the floating plate 370 and the valve body 346 of the third embodiment. Hereinafter, the structure of the fuel injection device 400 according to the fourth embodiment will be described in detail.

As in the floating plate 370 of the third embodiment, the floating plate 470 in the fourth embodiment has a reduced diameter portion 489 that reduces an outer diameter ϕC4 (see FIG. 12) of an outer edge 487 of a pressing surface 486, with respect to an outermost diameter ϕB4 of the floating plate 470.

The reduced diameter portion 489 extends in the shape of a circular ring around the displacement axis of the floating plate 470. Since the reduced diameter portion 489 is formed in the circular cone shape having different outer diameter, a circular ring-shaped cutout space 488 is formed outside in the radial direction of a pressing surface 486 in the state where the pressing surface 486 abuts on an abutting surface 490.

The reduced diameter portion 489 is inclined inward in the radial direction in the shape of a cone toward an end surface 473*a* that forms the pressing surface 486 and that is located in the displacement axis direction. Furthermore, the reduced diameter portion 489 is curved to have a part of a spherical shape.

Even if the reduced diameter portion 489 is formed in this shape, a ring-shaped depressed portion 492 (special depressed portion) can stride over an outer edge 487 of the pressing surface 486. Thus, it can prevent the problem that the time required for the close contact between the pressing surface 486 and the abutting surface 490 to be eliminated is varied by a shift in the position where the pressing surface 486 abuts on the abutting surface 490.

According to the above-described structure, the pressure in the pressure control chamber 53 is stably increased, and hence a variation in the timing at which the valve portion 50 (see FIG. 2) is closed by the nozzle needle 60 can be prevented. Thus, the injection accuracy of the fuel injection device 400 can be improved.

In a valve body 446 of the fourth embodiment, a connecting surface portion 496 configured to connect an inflow depressed portion 494 to an outflow depressed portion 497 is inclined inward in the radial direction toward the bottom side of the outflow depressed portion 497. Thus, when the connecting surface portion 496 is pressed by the pressing surface 486, the connection surface portion 496 is elastically deformed in a shape following the pressing surface 486.

When the floating plate 470 starts to be displaced in a direction to separate the pressing surface 486 from the abutting surface 490, the connecting surface portion 496, which is elastically deformed, is going to return to the shape inclined inward in the radial direction toward the bottom side of the outflow depressed portion 497. Thus, the fuel is easy to enter between the connecting surface portion 496 and the pressing surface 486, so that the close contact between the abutting surface 490 and the pressing surface 486 can be easily eliminated.

According to the above-described structure, the behavior of the floating plate 470 at the time of separating the pressing surface 486 from the abutting surface 490 can be made more stable.

In the fourth embodiment, the floating plate 470 is an example of the pressing member reciprocally displaced in the pressure control chamber 53.

Other Embodiments

As described above, a plurality of embodiments and modifications thereof have been described as examples. However, the present invention is not limited to these embodiments and modifications, and the present invention can be applied to various embodiments within a scope not departing from the gist of the present invention.

In the above-described embodiments, recess portions formed in the shape of a ring on the outer peripheral side of the inflow depressed portion have been described as the examples of a "special depressed portion".

However, the shape of the special depressed portion is not limited to the shape of the ring described above. For example, as for the "special depressed portion", a plurality of a circular arc-shaped depressed portions extending along the shape of the outer edge of the pressing surface may be arranged to form the shape of a ring as a whole. Alternatively, a plurality of small grooves may be formed on the outer peripheral side of the inflow depressed portion to form a knurled portion H (see JIS B 0951), and the knurled portion H may be adapted as the special depressed portion.

In the above-described embodiments, the pressing surface and the abutting surface are formed in the shape of a circle. In addition, the outflow depressed portion is depressed in the shape of a circle in the central portion of the radial direction of the abutting surface, and the ring-shaped depressed portion and the inflow depressed portion are formed in the shape of a circular ring that is concentric with the outflow depressed portion. However, the shapes of the pressing surface and the abutting surface are not limited to the shape of a circle but may be the shape of an ellipse or the like.

The shapes of the outflow depressed portion, the ring-shaped depressed portion, and the inflow depressed portion are not limited to the shape of a circle or a circular ring but may be the shape of an ellipse or a ring. The abutting surface, the outflow depressed portion, the ring-shaped depressed portion, and the inflow depressed portion may be not concentric with each other. In addition, the outflow depressed portion and the inflow depressed portion may be not formed at the abutting surface.

In the above-described embodiments, the width in the radial direction of the ring-shaped depressed portion is made larger than a difference between the inner diameter of the cylindrical wall portion of the cylinder and the outer diameter of the floating plate. However, if the ring-shaped depressed portion can stride over the outer edge of the pressing surface in the radial direction, the width in the radial direction of the ring-shaped depressed portion may be set at an appropriate value.

Figure 14:
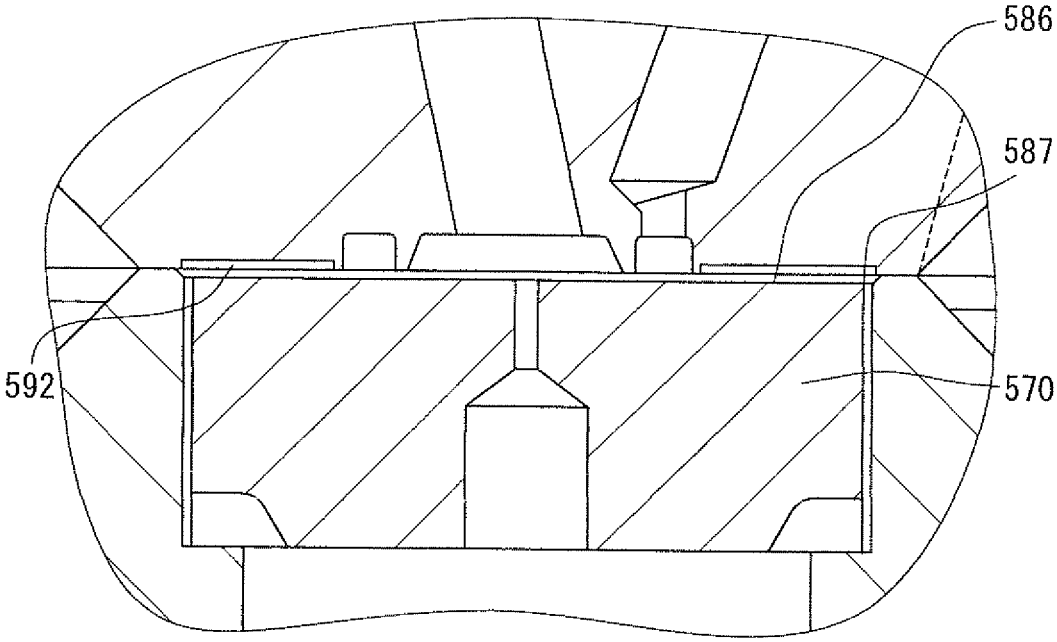
FIG. 14 is a view to show another modification of FIG. 4, according to the invention.

As shown in FIG. 14, when the width in the radial direction of a ring-shaped depressed portion 592 (special depressed portion) is enlarged, even if a floating plate 570 does not have a cutout portion, the ring-shaped depressed portion 592 can be made to stride over an outer edge 587 of a pressing surface 586.

It is desired that the volume of the cutout portion formed in the above-described embodiments is decreased to a maximum extent. When the volume of the cutout portion is decreased, the amount of the fuel stored in the pressure control chamber can be decreased.

When the amount of the fuel stored in the pressure control chamber can be decreased, the amount of the fuel to be discharged from the pressure control chamber by the time at which the nozzle needle starts to be displaced can be decreased. Thus, it is possible to reduce the effect that a variation in the flow rate of the fuel flowing out through the communication hole from the pressure control chamber, which is caused depending on the temperature of the fuel, produces on the timing at which the nozzle needle starts to be displaced.

Since a variation in the fuel injection caused depending on the temperature of the fuel can be reduced in this manner, the temperature characteristics of the fuel injection device can be improved.

Up to this point, there have been described examples in which the present invention is applied to the fuel injection device used for the diesel engine 20 that injects fuel directly into the combustion chamber 22. However, the present invention may be applied to a fuel injection device having a structure in which an inner wall in the radial direction of the pressure control chamber is not configured of an inner wall portion of a cylinder but is configured of an inner wall portion of a holder, or may be applied to a fuel injection device used for not only the diesel engine 20 but also an internal combustion engine such as an Otto cycle engine.

In addition, the fuel injected by the fuel injection device is not limited to light oil but may be gasoline, liquefied petroleum gas, and like. Furthermore, the present invention may be applied to a fuel injection device that injects fuel to a combustion chamber of an engine for burning fuel such as an external combustion engine.

Such changes and modifications are to be understood as being within the scope of the present invention as defined by the appended claims.

What is claimed is:

1. A fuel injection device comprising:

a control body having a pressure control chamber, into which fuel flowing through the supply channel flows from an inflow port and from which the fuel is discharged to the return channel through an outflow port, and an abutting surface exposed to the pressure control chamber and having the inflow port and the outflow port opened therein;

a pressure control valve configured to make communication between the outflow port and the return channel and to interrupt the communication, so as to control a pressure of the fuel in the pressure control chamber;

a valve member configured to open and close a valve portion in response to the pressure of the fuel in the pressure control chamber; and a pressing member arranged to be reciprocally displaced in the pressure control chamber and having a pressing surface abutting on the abutting surface when being reciprocally displaced, wherein the pressing surface presses the abutting surface to interrupt communication between the inflow port and the pressure control chamber when the communication between the outflow port and the return channel is made by the pressure control valve, the pressing surface is displaced to open the inflow port of the abutting surface to the pressure control chamber when the communication between the outflow port and the return channel is interrupted by the pressure control valve, and the abutting surface has an outer opposite surface portion that is opposite to an outer edge of the pressing surface in a displacement axis direction of the pressing member and is provided with a special depressed portion depressed in the displacement axis direction and extending along a shape of the outer edge of the pressing surface, wherein the abutting surface is surrounded by a cylindrical wall portion that has a circular cylinder shape and that defines the pressure control chamber, the pressing member having a circular disk shape is arranged in the cylindrical wall portion and has the pressing surface formed at an end surface in the displacement axis direction, and a width of the special depressed portion in a radial direction of the cylindrical wall portion is larger than a difference between an inner diameter of the cylindrical wall portion and an outer diameter of the pressing member.

2. The fuel injection device according to claim 1, wherein the special depressed portion has a ring shape extending along the shape of the outer edge of the pressing surface.

3. The fuel injection device according to claim 1, wherein the control body has an inflow depressed portion provided on an inner peripheral side of the special depressed portion, the inflow depressed portion being concentric with the special depressed portion and depressed from the abutting surface separately from the special depressed portion, and the inflow port is provided in the inflow depressed portion.

4. The fuel injection device according to claim 3, wherein peripheral wall surfaces on an inner peripheral side and an outer peripheral side of the inflow depressed portion are provided with a continuing surface portion continuously extending to the abutting surface along the displacement axis direction.

5. The fuel injection device according to claim 3, wherein a depth of the special depressed portion is smaller than a depth of the inflow depressed portion in the displacement axial direction.

6. The fuel injection device according to claim 3, wherein the control body has an outflow depressed portion provided on an inner peripheral side of the inflow depressed portion and in a central portion in the radial direction of the abutting surface, the outflow depressed portion is depressed from the abutting surface, and the outflow port is provided in the outflow depressed portion.

7. The fuel injection device according to claim 6, wherein the abutting surface has a connecting surface portion that is configured to connect the outflow depressed portion to the inflow depressed portion and is inclined inward in the radial direction toward a bottom side of the outflow depressed portion.

8. The fuel injection device according to claim 6, wherein a peripheral wall surface of the outflow depressed portion is inclined inward in the radial direction toward a bottom side of the outflow depressed portion.

9. The fuel injection device according to claim 6, wherein the inflow depressed portion has a stepped surface portion provided on an inner peripheral wall surface thereof, and the stepped surface portion has a reduced width in the radial direction of the inflow depressed portion on a bottom side of the inflow depressed portion.

10. The fuel injection device according to claim 1, wherein the pressing member has a reduced diameter portion provided outside in the radial direction of the pressing surface, and the reduced diameter portion has a reduced outer diameter of the pressing surface with respect to an outermost diameter of the pressing member.

11. The fuel injection device according to claim 10, wherein the pressing member is recessed toward an end surface that defines the pressing surface and that is located in the displacement axis direction, to form the reduced diameter portion.

12. The fuel injection device according to claim 10, wherein the pressing member has the reduced diameter portion inclined inward in the radial direction toward an end surface that defines the pressing surface and that is located in the displacement axis direction.

13. The fuel injection device according to claim 12, wherein the reduced diameter portion is curved to have a part of a spherical surface.

14. The fuel injection device according to claim 1, wherein the special depressed portion extends in a radial direction from an inner side of the outer edge of the pressing surface to an outer side of the outer edge of the pressing surface.

* * * * *